US012480521B2

(12) United States Patent
Oishi

(10) Patent No.: US 12,480,521 B2
(45) Date of Patent: Nov. 25, 2025

(54) IMPELLER, CENTRIFUGAL BLOWER, AND INDOOR UNIT

(71) Applicant: Mitsubishi Electric Corporation, Tokyo (JP)

(72) Inventor: Keisuke Oishi, Tokyo (JP)

(73) Assignee: Mitsubishi Electric Corporation, Tokyo (PA)

( * ) Notice: Subject to any disclaimer, the term of this patent is extended or adjusted under 35 U.S.C. 154(b) by 0 days.

(21) Appl. No.: 18/699,761

(22) PCT Filed: Jan. 17, 2022

(86) PCT No.: PCT/JP2022/001269

§ 371 (c)(1),
(2) Date: Apr. 9, 2024

(87) PCT Pub. No.: WO2023/135775

PCT Pub. Date: Jul. 20, 2023

(65) Prior Publication Data

US 2024/0410385 A1 Dec. 12, 2024

(51) Int. Cl.
*F04D 29/28* (2006.01)
*F01D 5/22* (2006.01)
(Continued)

(52) U.S. Cl.
CPC ..... *F04D 29/281* (2013.01); *F01D 5/225* (2013.01); *F04D 17/08* (2013.01); *F04D 29/30* (2013.01); *F24F 1/0022* (2013.01); *F24F 1/0047* (2019.02)

(58) Field of Classification Search
CPC ..... F04D 29/281; F04D 17/08; F04D 29/30; F01D 5/225; F24F 1/0022; F24F 1/0047
See application file for complete search history.

(56) References Cited

U.S. PATENT DOCUMENTS

2007/0098556 A1* 5/2007 Sanagi ..... F04D 29/282 416/182
2009/0047133 A1* 2/2009 Nishino ..... F04D 29/281 416/213 A

FOREIGN PATENT DOCUMENTS

JP H06-257595 A 9/1994
JP 2005-155510 A 6/2005
(Continued)

OTHER PUBLICATIONS

International Search Report of the International Searching Authority mailed Feb. 22, 2022 in corresponding International Application No. PCT/JP2022/001269 (and English translation).

*Primary Examiner* — Andrew J Marien
(74) *Attorney, Agent, or Firm* — Posz Law Group, PLC

(57) ABSTRACT

An impeller includes a shroud on a first side with respect to a base, and blades. The shroud has protruding accommodations that open to a second side opposite to the first side, and has protrusions protruding to the first side from a blade main body of the blades accommodated therein. Each protruding accommodation has a first accommodation, and a second accommodation connected to an end in the extension direction thereof. The protrusion has a first projection and a second projection accommodated within the first and second accommodations respectively, and the first projection is fixed to the shroud while contacting and being fixed to a surface located on a side out of an inner surface thereof. The second projection is connected to an end in the extension direction of the first projection, and faces a surface on a side of an inner surface of the second accommodation via a gap.

9 Claims, 15 Drawing Sheets

(51) Int. Cl.

| | |
|---|---|
| ***F04D 17/08*** | (2006.01) |
| ***F04D 29/30*** | (2006.01) |
| ***F24F 1/0022*** | (2019.01) |
| *F24F 1/0047* | (2019.01) |

(56) References Cited

FOREIGN PATENT DOCUMENTS

| | | | |
|---|---|---|---|
| JP | 2007-239567 | A | 9/2007 |
| JP | 2009-257132 | A | 11/2009 |

* cited by examiner

IMPELLER, CENTRIFUGAL BLOWER, AND INDOOR UNIT

CROSS-REFERENCE TO RELATED APPLICATION

This application is a U.S. National Stage Application of International Application No. PCT/JP2022/001269 filed Jan. 17, 2022, the contents of which are incorporated herein by reference.

TECHNICAL FIELD

The present disclosure relates to an impeller, a centrifugal blower, and an indoor unit

BACKGROUND

A centrifugal blower having an impeller is known. For example, as in Patent Document 1, an impeller that includes a formed side plate to which a fitting recess of an end of a hollow blade is fitted to is mentioned.

PATENT DOCUMENT

[Patent Document 1] Japanese Unexamined Application No. 2005-155510, First Publication As in the impeller above, to have an end of a hollow blade firmly contact an inner surface of a fitting recess so as to fix the hollow blade to a side plate, a gap is provided between a portion out of the hollow blade other than the portion that contacts the inner surface of the fitting recess and the side plate. Air flow from a positive pressure side of the hollow blade to a negative pressure side of the hollow blade forms via said gap, and a problem of a decrease in air blowing efficiency by the impeller exists.

SUMMARY

The present disclosure has been made in order to address the problem above, and an object is to provide a centrifugal blower that includes an impeller, the impeller having a configuration that suppresses decrease in air blowing efficiency, and an air conditioner that includes said blower.

An impeller according to an embodiment of the present disclosure is rotatable around a rotation axis, and includes a base; a shroud that is located on a first side out of an axial direction of the rotation axis with respect to the base, and a plurality of blades that are located between the base and the shroud in the axial direction, and are disposed with an interval therebetween in a direction of rotation of the impeller, wherein the shroud has a shroud main body, and a plurality of protruding accommodations that protrude from the shroud main body to the first side, and that open to a second side which is an opposite side to the first side out of the axial direction, each of the plurality of blades has a blade main body, and a protrusion that protrudes to the first side from the blade main body, a first end of the blade main body in an extension direction that the blade main body extends in, as seen from the axial direction, is located on an inside in a radial direction having a center be the rotation axis more than a second end of the blade main body in the extension direction, the protrusion in the plurality of blades is accommodated within each of the plurality of protruding accommodations, each of the protruding accommodations has a first accommodation, and a second accommodation that is connected to an end in the extension direction of the first accommodation, the protrusion has a first projection that is accommodated within the first accommodation, and is fixed to the shroud, and a second projection that is connected to an end in the extension direction of the first projection, and is accommodated within the second accommodation, and the first projection contacts and is fixed to a surface located on the first side out of an inner surface of the first accommodation, and the second projection faces a surface located on the first side out of an inner surface of the second accommodation via a gap, and an end out of ends in the extension direction of the second projection, that is on an opposite side to the side to which the first projection is connected to, is connected to the first end in the extension direction of the blade main body with no step.

A centrifugal blower according to an embodiment of the present disclosure may include the impeller mentioned above, and a drive portion that rotates the impeller around the rotation axis.

An indoor unit according to an embodiment of the present disclosure may include the centrifugal blower mentioned above, and a heat exchanger that has air which is blown by the centrifugal blower.

According to the present invention, it is possible to suppress decrease in air blowing efficiency if an impeller in a centrifugal blower.

DETAILED DESCRIPTION

Figure 1:
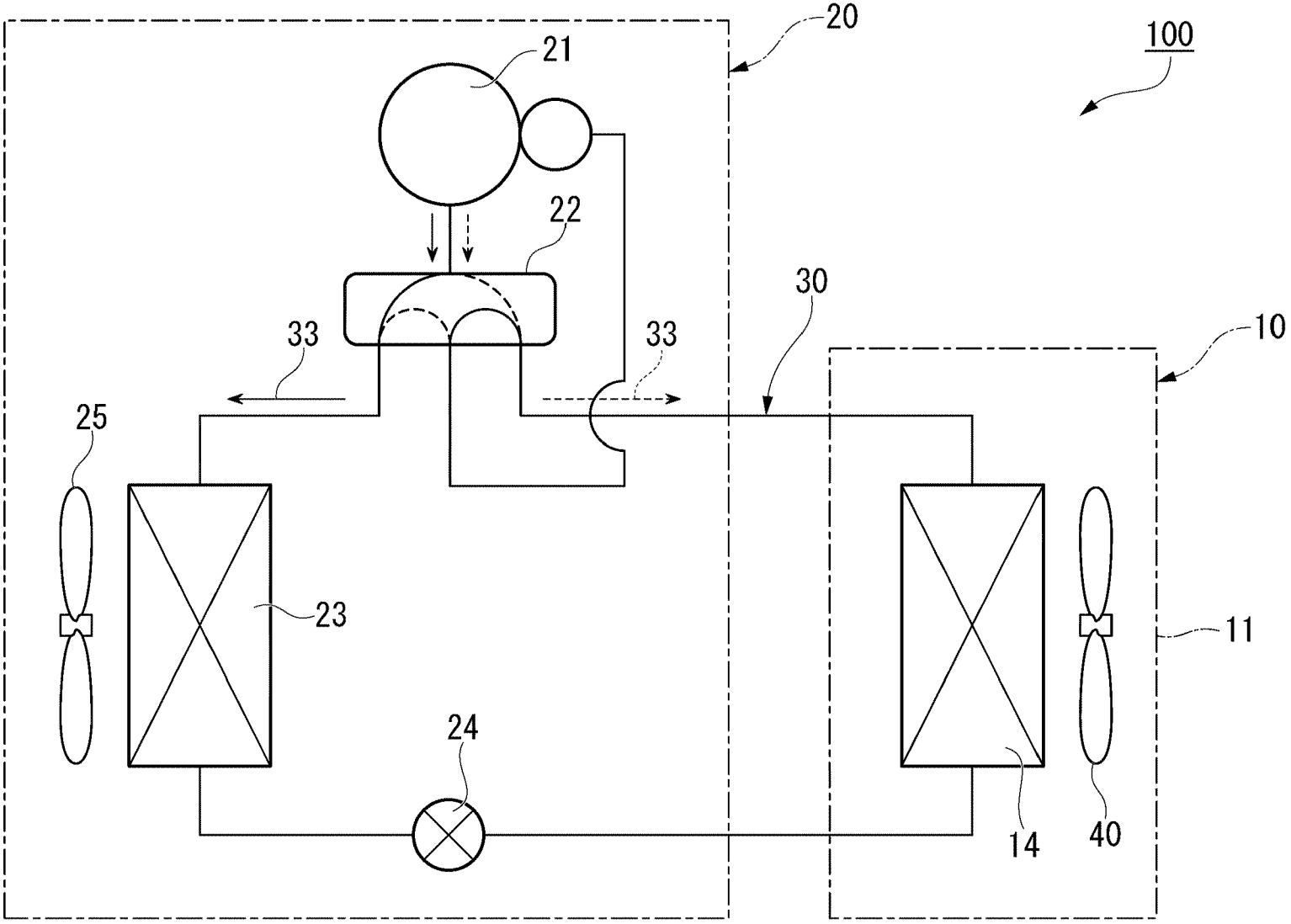
FIG. 1 A schematic view that shows an outline configuration of an air conditioner in a first embodiment.

Hereinafter, embodiments of the present disclosure are explained with reference to the drawings. The scope of the present disclosure is not limited to the embodiments below, and may be changed so long as the embodiments do not depart from the technical scope of the present disclosure. In the drawings below, scales and dimensions of various configurations may differ from scales and dimensions in the drawings below to facilitate better understanding of the various embodiments.

The drawings show a Z axis where appropriate. The Z axis shows a vertical direction. A side out of a vertical direction Z in which an arrow of the Z axis points to (+Z side) is referred to as "top side", and an opposite side out of the vertical direction Z which the arrow of the Z axis points to (−Z side) is a "bottom side". In the embodiments below, the vertical direction Z corresponds to a rotation axis R, to be mentioned later on. The bottom side in an axial direction out of the rotation axis R corresponds to a "first side", and the top side, which is an opposite side to the first side in the axial direction out of the rotation axis R corresponds to a "second side".

First Embodiment

FIG. 1 is a schematic view that shows an outline configuration of an air conditioner 100 in a first embodiment. As shown in FIG. 1, the air conditioner 100 includes an indoor unit 10, an outdoor unit 20, and a circulation pathway 30. The indoor unit 10 is disposed indoors. The outdoor unit 20 is disposed outdoors. The indoor unit 10 and the outdoor unit 20 are connected via the circulation pathway 30 having a refrigerant 33 circulate therein. The indoor unit 10 and the outdoor unit 20 are heat exchange units that conduct heat exchange with the air.

The air conditioner 100 adjusts a temperature of the indoors air by conducting heat exchange between the refrigerant 33 that flows within a circulation path 30, and indoors air where the indoor unit 10 is disposed. A refrigerant such as a fluorine based refrigerant with a low global warming potential (GWP: Global Warming Potential), or a hydrocarbon based refrigerant or the like may be mentioned as examples of the refrigerant 33.

The outdoor unit 20 has a compressor 21, a heat exchanger 23, a flow adjustment valve 24, a blower 25, and a four-way valve 22. The compressor 21, the heat exchanger 23, the flow adjustment valve 24, and the four-way valve 22, are connected by the circulation pathway 30.

Out of the circulation pathway 30, the four-way valve 22 is provided on a portion that is connected to a discharge of the compressor 21. By exchanging a part of the circulation pathway 30, it is possible for the four-way valve 22 to reverse a direction of flow of the refrigerant 33 within the circulation pathway 30. When the path connected by the four-way valve 22 is the path of the four-way valve 22 that is shown by solid lines in FIG. 1, the refrigerant 33 within the circulation pathway 30 flows in the direction shown by the solid line arrow in FIG. 1. On the other hand, when the path connected by the four-way valve 22 is the path of the four-way valve 22 that is shown by dashed lines in FIG. 1, the refrigerant 33 flows within the circulation pathway 30 in the direction shown by the dashed line arrow in FIG. 1.

The indoor unit 10 includes a housing 11, a heat exchanger 14, and a centrifugal blower 40. It is possible for the indoor unit 10 to have a cooling operation of the indoor air, where the indoor unit 10 is disposed, is cooled. It is possible to have a heating operation of the indoor air, where the indoor unit 10 is disposed, is heated.

When the indoor unit 10 is operated in the cooling operation, the refrigerant 33 that flows within the circulation pathway 30 flows in the direction shown by the solid line in FIG. 1. In other words, when the indoor unit 10 is operated in the cooling operation, the refrigerant 33 that flows within the circulation pathway 30 circulates so as to return to the compressor 21 after passing through the compressor 21, the heat exchange device 23 of the outdoor unit 20, the flow adjustment valve 24, and the heat exchanger 14 of the indoor unit 10 in such an order. During the cooling operation, the heat exchange device 23 of the outdoor unit 20 functions as a condenser, and the heat exchanger 14 of the indoor unit 10 functions as an evaporator.

On the other hand, when the indoor unit 10 is operated in the heating operation, the refrigerant 33 that flows within the circulation pathway 30 flows in the direction shown by the dashed line in FIG. 1. In other words, when the indoor unit 10 is operated in the heating operation, the refrigerant 33 that flows within the circulation pathway 30 circulates so as to return to the compressor 21 after passing through the compressor 21, the heat exchanger 14 of the indoor unit 10, the flow adjustment valve 24, and the heat exchange device 23 of the outdoor unit 20 in such an order. During the heating operation, the heat exchange device 23 of the outdoor unit 20 functions as the evaporator, and the heat exchanger 14 of the indoor unit 10 functions as the condenser.

Figure 2:
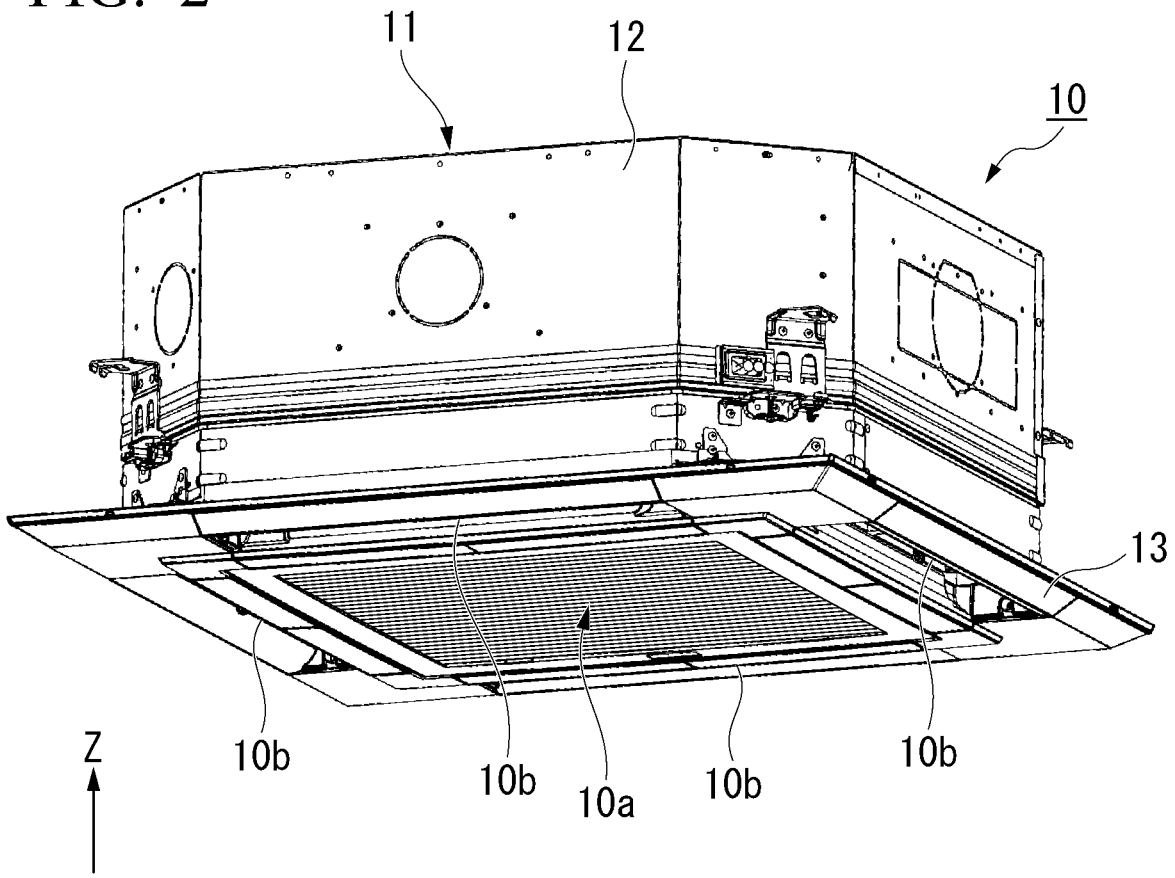
FIG. 2 A prospective view that shows the indoor unit in the first embodiment.
Figure 3:
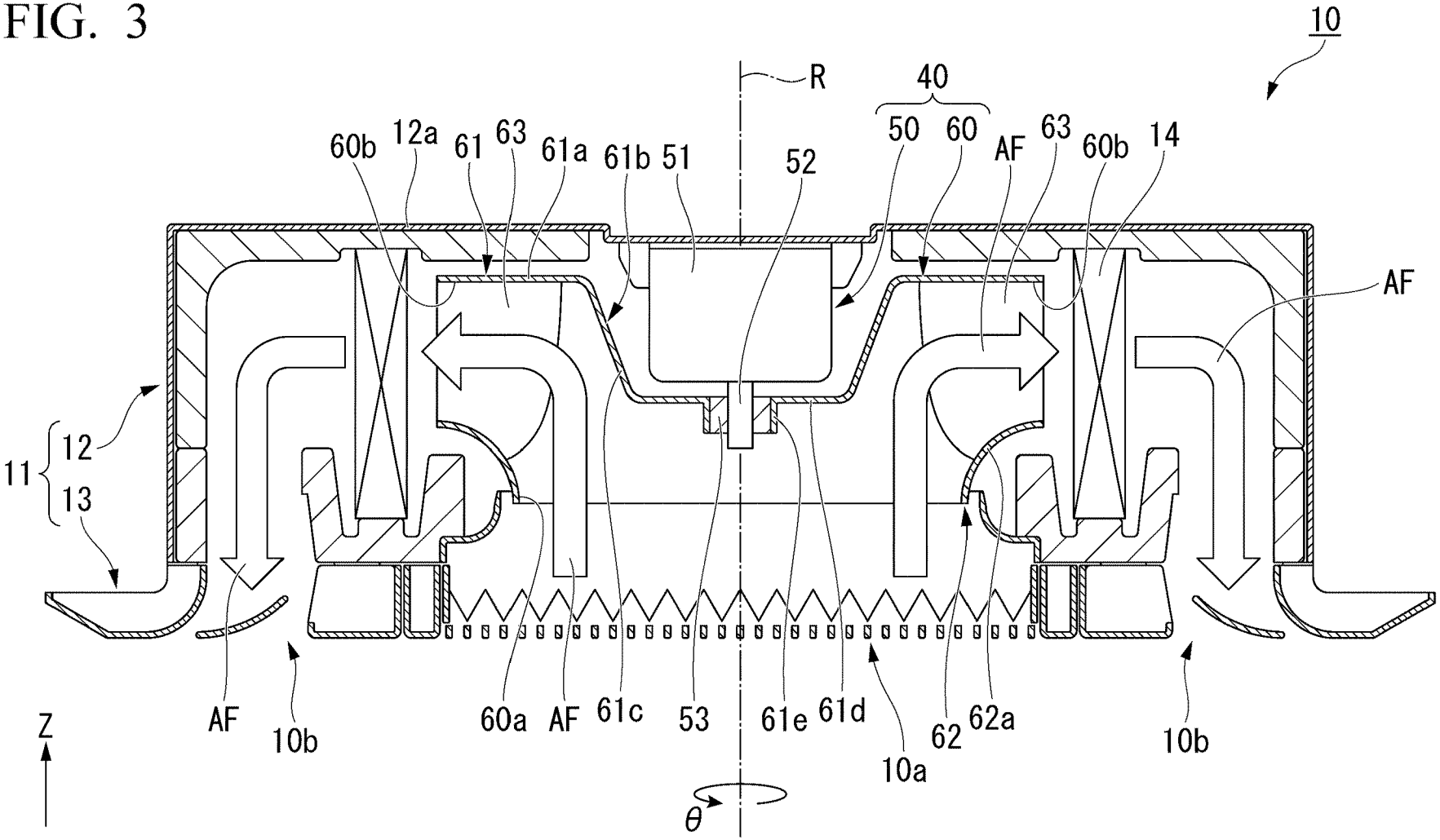
FIG. 3 A cross-sectional view that shows the indoor unit in the first embodiment.

Next, the indoor unit 10 in the first embodiment is explained in further detail. FIG. 2 is a prospective view that shows the indoor unit 10. FIG. 3 is a cross-sectional view that shows the indoor unit 10. As shown in FIG. 2 and FIG. 3, the indoor unit 10 in the first embodiment is a ceiling-mounted indoor unit that is provided so as to be mounted within a ceiling. As shown in FIG. 3, the housing 11 houses the heat exchanger 14 and the centrifugal blower 40. The housing 11 has a housing main body 12 that houses the heat exchanger 14 and the centrifugal blower 40 housed on an inside thereof, and a decorative panel 13 that is attached below the housing main body 12. The housing main body 12 is installed so as to be embedded in the ceiling indoors where the indoor unit 10 is installed. The decorative panel 13 is exposed indoors where the indoor unit 10 is installed.

The heat exchanger 14 is housed within the housing main body 12. Air is sent to the heat exchanger 14 by the centrifugal blower 40. The heat exchanger 14 is a frame shape that surrounds the centrifugal blower 40. The heat exchanger 14 is disposed so as to face an air exhaust port **60*b*** to be mentioned later on.

The indoor unit 10 has an intake port **10*a* and an exhaust port 10*b*. The intake port 10*a* and the exhaust port 10*b* open to a bottom surface of the decorative panel 13. As shown in FIG. 2, the intake port 10*a* is located on a center of the indoor unit 10, as seen from the vertical direction Z. A plurality of exhaust ports 10*b* are provided. The plurality of exhaust ports 10*b* are disposed so as to surround the intake port 10*a*, as seen from the vertical direction Z. Four exhaust ports 10*b*** are provided.

The centrifugal blower 40 is a blower that sends air to the heat exchanger 14. By the centrifugal blower 40 operating, air flows to an inside of the indoor unit 10. Arrows AF in FIG. 3 show the air flow that is generated when the centrifugal blower 40 operates. As shown by the arrows AF in FIG. 3, when the centrifugal blower 40 operates, air is taken into the inside of the indoor unit 10 from the intake port 10*a*. Air that is taken into the inside of the indoor unit 10 from the intake port 10*a* passes through the heat exchanger 14, and is exhausted to the indoors from the four exhaust ports 10*b*.

The centrifugal blower 40 is fixed to a bottom surface of a ceiling panel 12*a* of the housing 12. The centrifugal blower 40 includes a drive portion 50 and an impeller 60. The drive portion 50 causes the impeller 60 to rotate around the rotation axis R. The rotation axis R shown where appropriate in the drawings is a theoretical axis that extends in the vertical direction Z. In other words, the axial direction of the rotation axis R is the vertical direction Z. The rotation axis R passes through a center of the indoor unit 10 as seen from the vertical direction Z.

Hereinafter, unless specified otherwise, a radial direction with a center being the rotation axis R is simply referred to as a "radial direction", and a circumferential direction around the rotation axis R is referred to as a "circumferential direction". Where appropriate, a direction of rotation is shown by an arrow θ in the drawings. The impeller 60 rotates in the direction that the arrow θ points to. A side (+θ side) out of the direction of rotation to which the arrow θ points to is a "front side", and an opposite side (−θ side) out of the direction of rotation to which the arrow θ points to is a "rear side". The front side in the direction of rotation (+θ side) is a side that progresses as said side rotates counter-clockwise with the rotation axis R as a center, as seen from the bottom side. The rear side in the direction of rotation (−θ side) is a side that progresses as said side rotates clockwise with the rotation axis R as the center, as seen from the bottom side.

In the first embodiment, the drive portion 50 is a motor. The drive portion 50 has a drive portion main body 51 that is fixed to the bottom surface of the ceiling panel 12*a*, and a rotation shaft 52 that protrudes to the bottom side, more than the drive portion main body 51 from an inside of the drive portion main body 51. The rotation shaft 52 is a portion of a rotor in the drive portion 50. The rotation shaft 52 is rotatable around the rotation axis R. So long as it is possible to have the impeller 60 rotate around the rotation axis R, a configuration of the drive portion 50 is not limited to any particular configuration.

Figure 4:
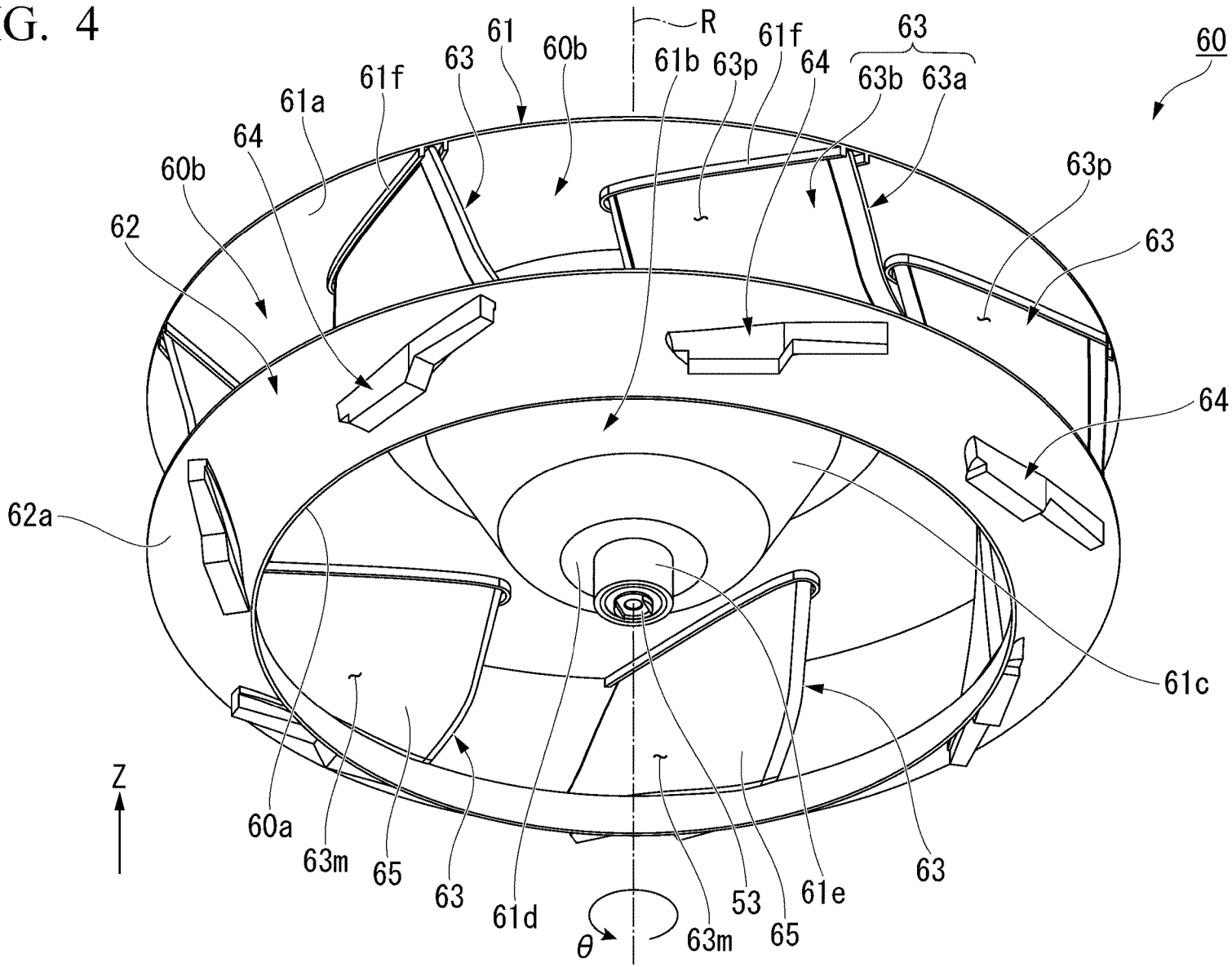
FIG. 4 A perspective view that shows an impeller in the first embodiment.
Figure 5:
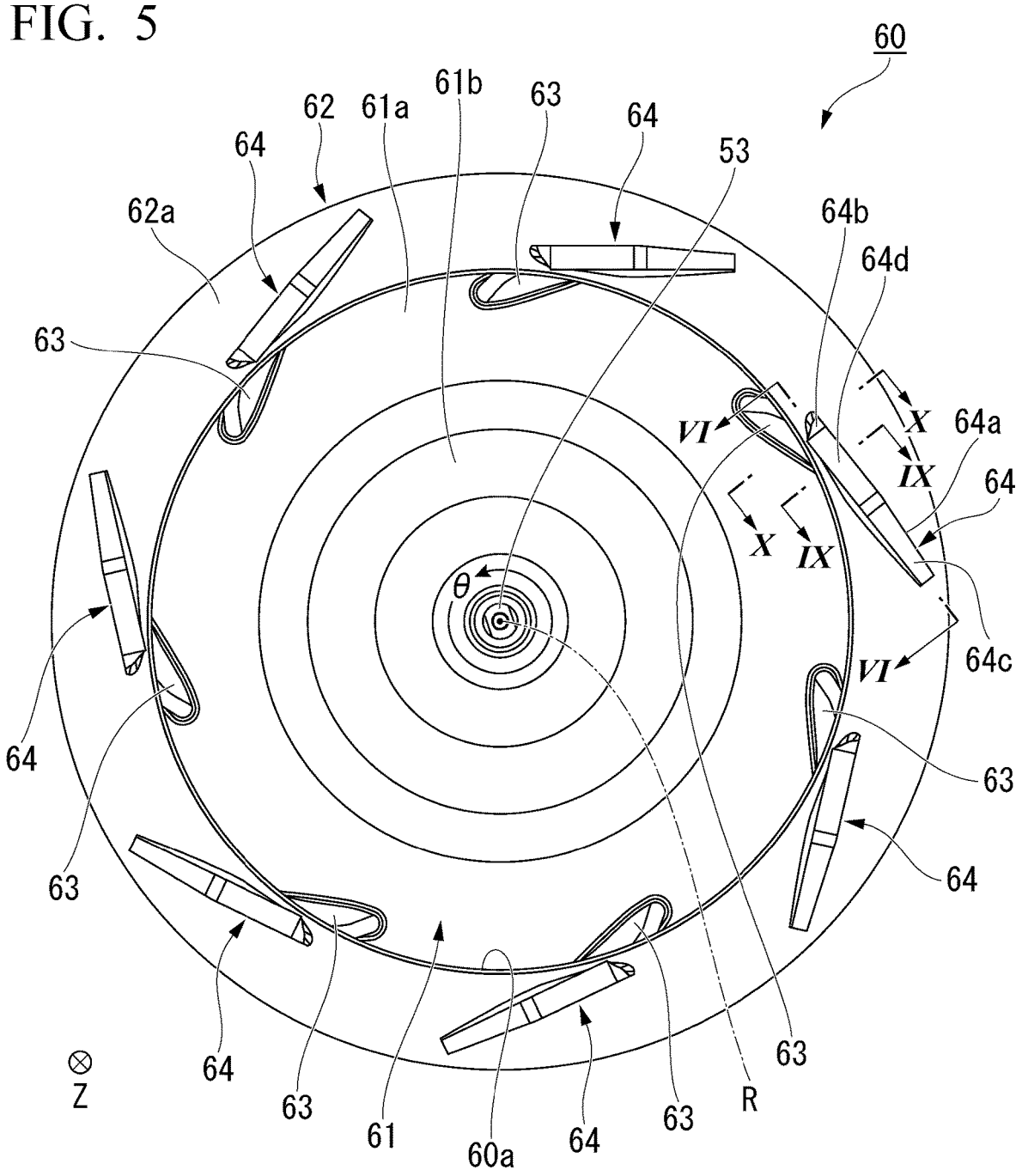
FIG. 5 A view that shows the impeller as seen from a bottom side in the first embodiment.

The impeller 60 is rotatable around the rotation axis R. The impeller 60 for example, is made of resin. The impeller 60 is fixed via a connecting member 53 to a portion out of the rotation shaft 52 of the drive portion 50 that protrudes to the bottom side more than the drive portion main body 51. The connecting member 53 is a cylindrical shaped member having the rotation axis R as a center thereof. The connecting member 53 is fixed to an outer circumferential surface of the rotation shaft 52. FIG. 4 is a perspective view that shows the impeller 60. FIG. 5 is a view that shows the impeller 60 as seen from the bottom side. As shown in FIG. 3 to FIG. 5, the impeller 60 includes a base 61, a shroud 62, and a plurality of blades 63.

The base 61 is fixed to the rotation shaft 52 via the connecting member 53. As shown in FIG. 4, the base 61 has a circular plate 61*a*, a bulge 61*b*, and a plurality of guides 61*f*. The circular plate 61*a* is a circular plate shape with the rotation axis R as a center thereof. The bulge 61*b* protrudes from an inner circumferential edge in the radial direction of the circular plate 61*a*, to the bottom side. The bulge 61*b* is a tubular shape having the rotation axis R as a center. As shown in FIG. 3, the drive portion main body 51 is located on an inside of the bulge 61*b*. The bulge 61*b* has a circumferential wall 61*c*, a bottom plate 61*d*, and a cylinder 61*e*.

The circumferential wall 61*c* opens to the top side, and is a cylindrical shape having the rotation axis R as a center thereof. An inner diameter of the circumferential wall 61*c* and an outer diameter of the circumferential wall 61*c* become smaller as diameters thereof approach the bottom side. The bottom plate 61*d* is connected to a bottom end of the circumferential wall 61*c*. The bottom plate 61*d* is a circular plate shape with the rotation axis R as a center thereof. The cylinder 61*e* protrudes to the bottom side from an inner circumferential edge in the radial direction of the bottom plate 61*d*. The cylinder 61*e* opens to the bottom side, and is a cylindrical shape having the rotation axis R as a center thereof. The connecting member 53 is fixed to an inner circumferential surface of the cylinder 61*e*. The cylinder 61*e* is fixed to the rotation shaft 52 via the connecting member 53.

As shown in FIG. 4, the plurality of guides 61*f* are formed on a bottom surface of the circular plate 61*a*. The plurality of guides 61*f* extend so as to incline in the direction of rotation with respect to the radial direction, and are long thin semi-U shapes that open to an outside in the radial direction, as seen from the vertical direction Z. The plurality of guides 61*f* are located on the front side (+θ side) in the direction of rotation as an inside in the radial direction is approached. The plurality of guides 61*f* are mutually disposed with an interval therebetween, over a circumference in the direction of rotation. Seven guides 61*f* are provided in the first embodiment. Intervals between each of the guides 61*f* may be of similar lengths, and may be of differing lengths.

The shroud 62 is separately located on the bottom side of the circular plate 61*a* in the base 61. In other words, the shroud 62 is located on the bottom side (the first side) with respect to the base 61 out of directions in the axial direction of the rotation axis R. The shroud 62 is a circular shape with the rotation axis R as a center thereof. An inner edge in the radial direction of the shroud 62 is located to the outside in the radial direction more than the bulge 61*b*. The shroud 62 is a cylindrical shape that opens to both sides in the vertical direction Z, with the rotation axis R as a center thereof. An inner diameter of the shroud 62 and an outer diameter of the shroud 62 become smaller as diameters thereof approach the bottom side. The shroud 62 has a shroud main body 62*a* and a plurality of protruding accommodation 64.

The shroud main body 62*a* is a cylindrical shape that opens to both sides in the vertical direction Z, with the rotation axis R as a center thereof. An inner diameter of the shroud main body 62*a* and an outer diameter of the shroud main body 62*a* become smaller as diameters thereof approach the bottom side. As shown in FIG. 3, in a cross-section that is orthogonal with the direction of rotation, a shape of the shroud main body 62*a* is an arc shape which protrudes towards the inside in the radial direction, and to an inclined top direction.

An inner edge in the radial direction of the shroud main body 62*a* is a bottom end of the shroud main body 62*a*. The inner edge of the shroud main body 62*a* is an air intake port 60*a* that opens to the bottom side. The air intake port 60*a* is separately located on the top side of the intake port 10*a* of the indoor unit 10.

An outer edge in the radial direction of the shroud main body 62*a* is a top end of the shroud main body 62*a*. As shown in FIG. 4, a plurality of air exhaust ports 60*b*, that open to the outside in the radial direction, are formed by the plurality of blades 63 partitioning a space in the vertical direction Z, between the outer edge in the radial direction of the shroud main body 62*a* and an outer edge in the radial direction of the circular plate 61*a*. The plurality of air exhaust port 60*b* are mutually disposed over a circumference in the direction of rotation, with an interval therebetween. Seven air exhaust ports 60*b* are provided in the first embodiment. As shown in FIG. 3, the heat exchanger 14 is disposed so as to face each of the air exhaust ports 60*b* from the outside in the radial direction thereof. Intervals between each of the plurality of air exhaust ports 60*b* may be of similar lengths, and may be of differing lengths.

When the impeller 60 is made to rotate around the rotation axis R by the drive portion 50, air that is taken into the indoor unit 10 from the intake port 10*a* flows to an inside of the impeller 60, from the air intake port 60*a*. The air that flows to the inside of the impeller 60 is discharged to the outside in the radial direction from the plurality of air exhaust ports 60*b*. The air that is discharged from the plurality of air exhaust port 60*b* passes through the heat exchanger 14, and is discharged to the indoors from a plurality of exhaust ports 10*b*.

Figure 6:
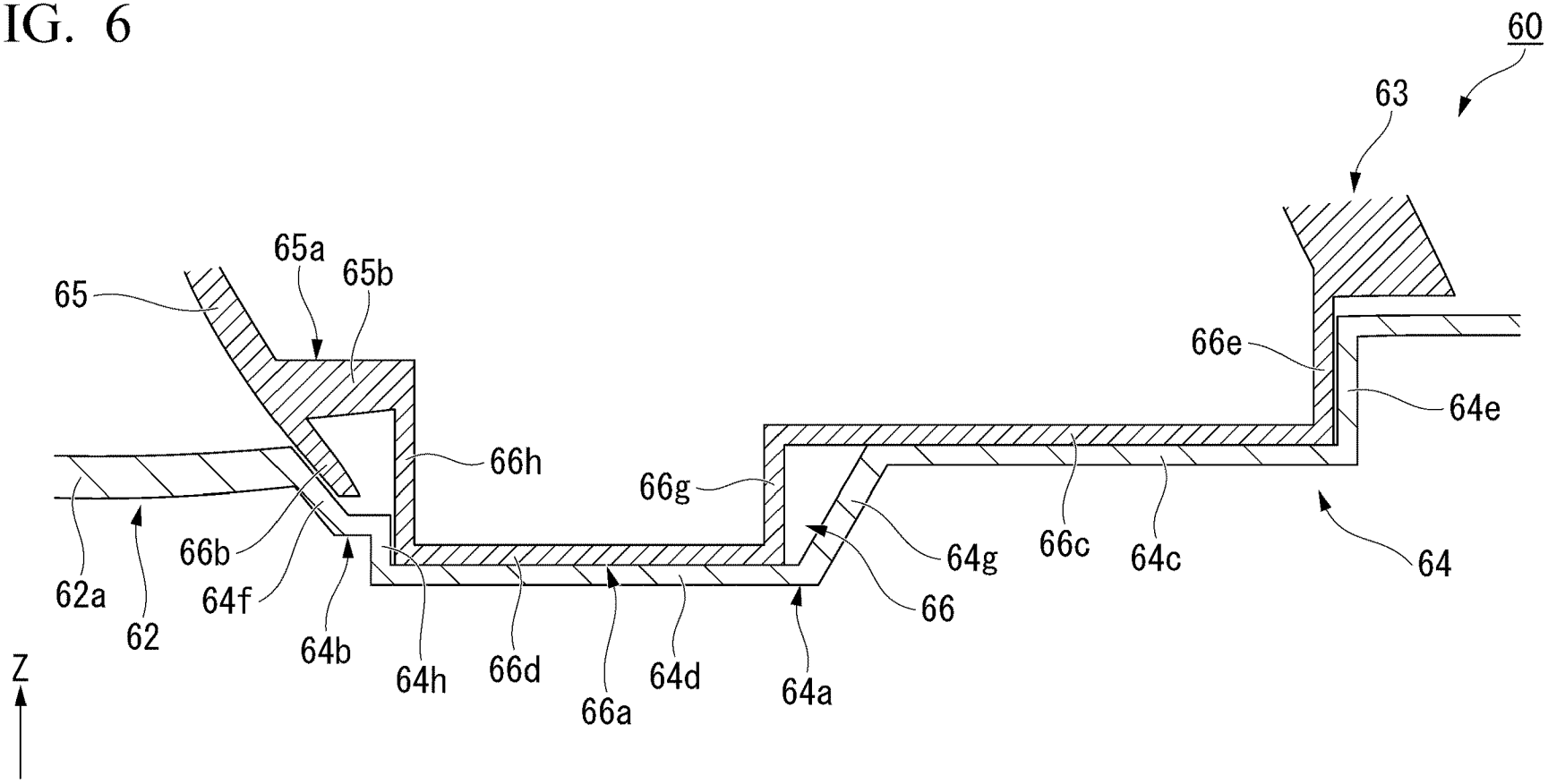
FIG. 6 A cross-sectional view that shows a protruding accommodation and a protrusion in the first embodiment, taken from a cross-sectional line VI-VI in FIG. 5.
Figure 7:
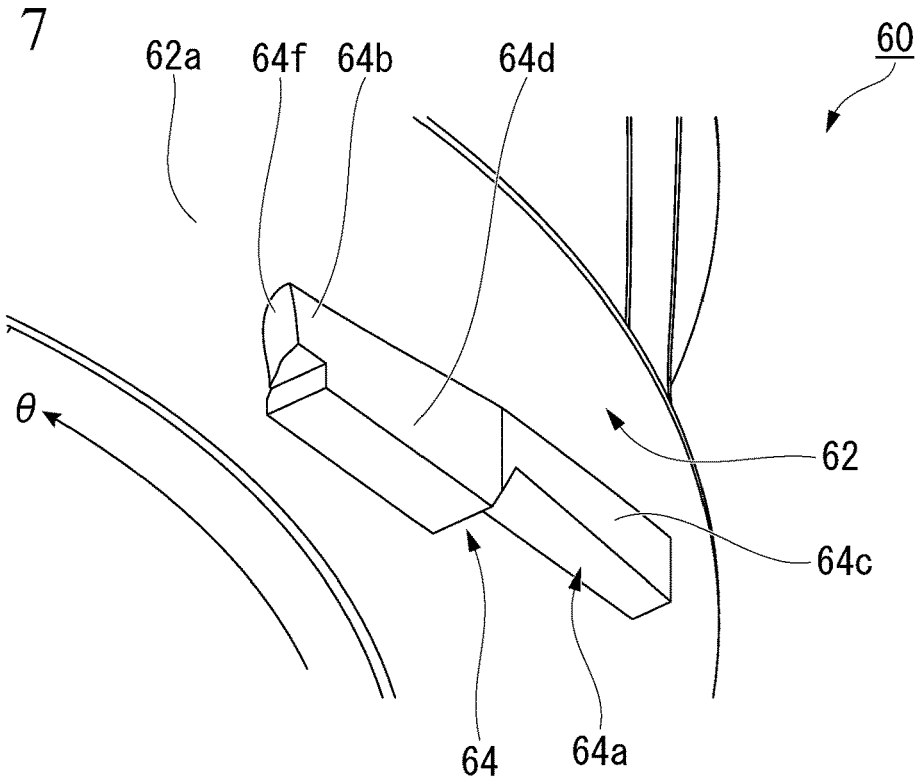
FIG. 7 A perspective view that shows the protruding accommodation in the first embodiment.

FIG. 6 is a cross-sectional view that shows a protruding accommodation 64 and a protrusion 66 to be mentioned later on, taken from the cross-sectional line VI-VI in FIG. 5. FIG. 7 is a perspective view that shows the protruding accommodation 64. As shown in FIG. 6 and FIG. 7, the plurality of the protruding accommodations 64 protrude from the shroud main body 62*a* to the bottom side. As shown in FIG. 6, the plurality of protruding accommodations 64 are hollow. The plurality of protruding accommodations 64 open to the top side. As shown in FIG. 5, each of the plurality of protruding accommodations 64 extend so as to incline in the direction of rotation with respect to the radial direction, as seen from the vertical direction Z. An inside end of each of the protruding accommodations 64 in the radial direction is located more to the front side (+θ side) in the direction of rotation than outside ends of each of the protruding accommodations 64 in the radial direction. Each of the protruding accommodations 64 extends in a straight line inclined towards a direction located on the front side in the direction of rotation, as said accommodations approach the inside in the radial direction, as seen from the vertical direction Z.

As seen from the vertical direction Z, a direction in which each of the protruding accommodations 64 extend is a direction of extension that a blade main body 65, to be mentioned later on, extends in. In the explanations below, a direction to which the blade main body 65 extends in is referred to as the "extension direction". A side which is the inside in the radial direction in the extension direction, is referred to as an "inside in the extension direction". A side which is the outside in the radial direction in the extension direction, is referred to as an "outside in the extension direction". The inside in the extension direction is a side which is the inside in the radial direction, and is the front side (+θ side) in the direction of rotation. The outside in the extension direction is a side which is the outside in the radial direction, and is the rear side (−θ side) in the direction of rotation. For example, the left side in FIG. 6 is the inside in the extension direction, and the right side in FIG. 6 is the outside in the extension direction.

As shown in FIG. 6 and FIG. 7, each of the plurality of protruding accommodations 64 has a first accommodation 64*a*. The first accommodation 64*a* is a semi-rectangular box that extends in the direction which the protruding accommodation 64 extends in. The first accommodation 64*a* has an outside portion 64*c*, and an inside portion 64*d*. The outside portion 64*c* is a portion out of the first accommodation 64*a* that extends to the outside in the extension direction. The inside portion 64*d* is a portion out of the first accommodation 64*a* that extends to the inside in the extension direction. An outside end in the extension direction of the outside portion 64*c* is an outside end in the extension direction of the first accommodation 64*a*. An inside end in the extension direction of the inside portion 64*d* is the inside end in the extension direction of the first accommodation 64*a*. The outside portion 64*c* is located to the outside in the radial direction more than the inside portion 64*d*. The inside portion 64*d* is connected to the inside end in the extension direction of the outside portion 64*c*.

A bottom end of the outside portion 64*c* is located more to the top side than a bottom end of the inside portion 64*d*. The outside portion 64*c* is disposed in a location that is recessed to the top side with respect to the inside portion 64*d*. By having the outside portion 64*c* be recessed to the top side, it is possible to suppress interference between the protruding accommodation 64 and other parts disposed on the bottom side on the outside in the radial direction of the shroud 62. As shown in FIG. 6, a side wall portion 64*e* of the outside in the extension direction of the outside portion 64*c* extends in the vertical direction Z from the shroud main body 62*a*. A step wall portion 64*g* between the outside portion 64*c* and the inside portion 64*d* inclines in the vertical direction Z, towards the extension direction in which the protruding accommodation 64 extends to. The step wall portion 64*g* is located on the inside in the extension direction as a bottom side thereof is approached.

Each of the plurality of protruding accommodations 64 has the inner accommodation 64*b*. The inner accommodation 64*b* is a second accommodation that is connected to an end in the extension direction of the first accommodation 64*a*. The inner accommodation 64*b* is connected to an end in the extension direction of the first accommodation 64*a* on the inside. To be more specific, the inner accommodation 64*b* is connected to the end on an inside of the inside portion 64*d* in extension direction. As such, in the first embodiment, each of the plurality of protruding accommodations 64 has the inner accommodation 64*b*, as the second accommodation, connected to an end located on the inside in the radial direction out of both ends in the extension direction of the first accommodation 64*a*. An end on an inside in the extension direction of the inner accommodation 64*b* is an end on an inside in the extension direction of the protruding accommodation 64. The inner accommodation 64*b* is a box shape that opens to the top side. An inside of the inner accommodation 64*b* is connected to an inside of the first accommodation 64*a*.

An end on the bottom side of the inner accommodation 64*b* is located more to the top side than the lowest portion located on the bottom side out of the first accommodation 64*a*. The lowest portion located on the bottom side out of the first accommodation 64*a* in the first embodiment is the bottom end of the inside portion 64*d*. A bottom end of the inner accommodation 64*b* is recessed to the top side more than the bottom end on an inside end in the extension direction of the inside portion 64*d*. A step wall portion 64*h* between the inner accommodation 64*b* and the first accommodation 64*a* extends in the vertical direction Z.

As shown in FIG. 5 and in FIG. 7, the inner accommodation 64*b* is a semi-triangular shape, as seen from the vertical direction Z. As shown in FIG. 6, a side wall portion 64*f* of the inside in the extension direction of the inner accommodation 64*b* inclines to the extension direction, with respect to the vertical direction Z. The side wall portion 64*f* is located on the outside in the extension direction as a bottom side thereof is approached. The side wall portion 64*f* extends along an inner projection 66*b* to be mentioned later on.

As shown in FIG. 4, the plurality of blades 63 are located between the base 61 and the shroud 62 in the vertical direction Z. More specifically, the plurality of blades 63 are located between the circular plate 61*a* and the shroud 62 in the vertical direction Z. The plurality of blades 63 are connected to the base 61 and to the shroud 62. The plurality of blades 63 are disposed with an interval therebetween in the direction of rotation of the impeller 60. The plurality of blades 63 are mutually disposed via an interval therebetween, over a circumference in the direction of rotation. Seven blades 63 are provided in the first embodiment. Intervals between each of the blades 63 may be of similar lengths, and may be of differing lengths.

Figure 8:
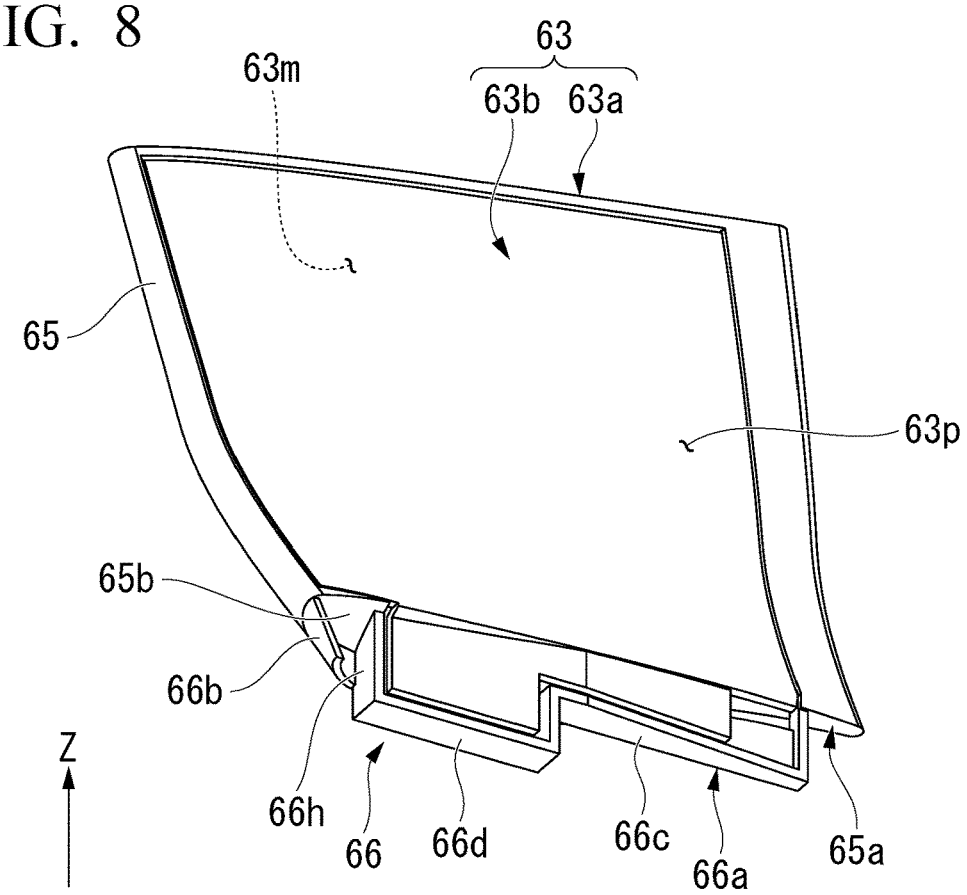
FIG. 8 A perspective view that shows a blade in the first embodiment.
Figure 9:
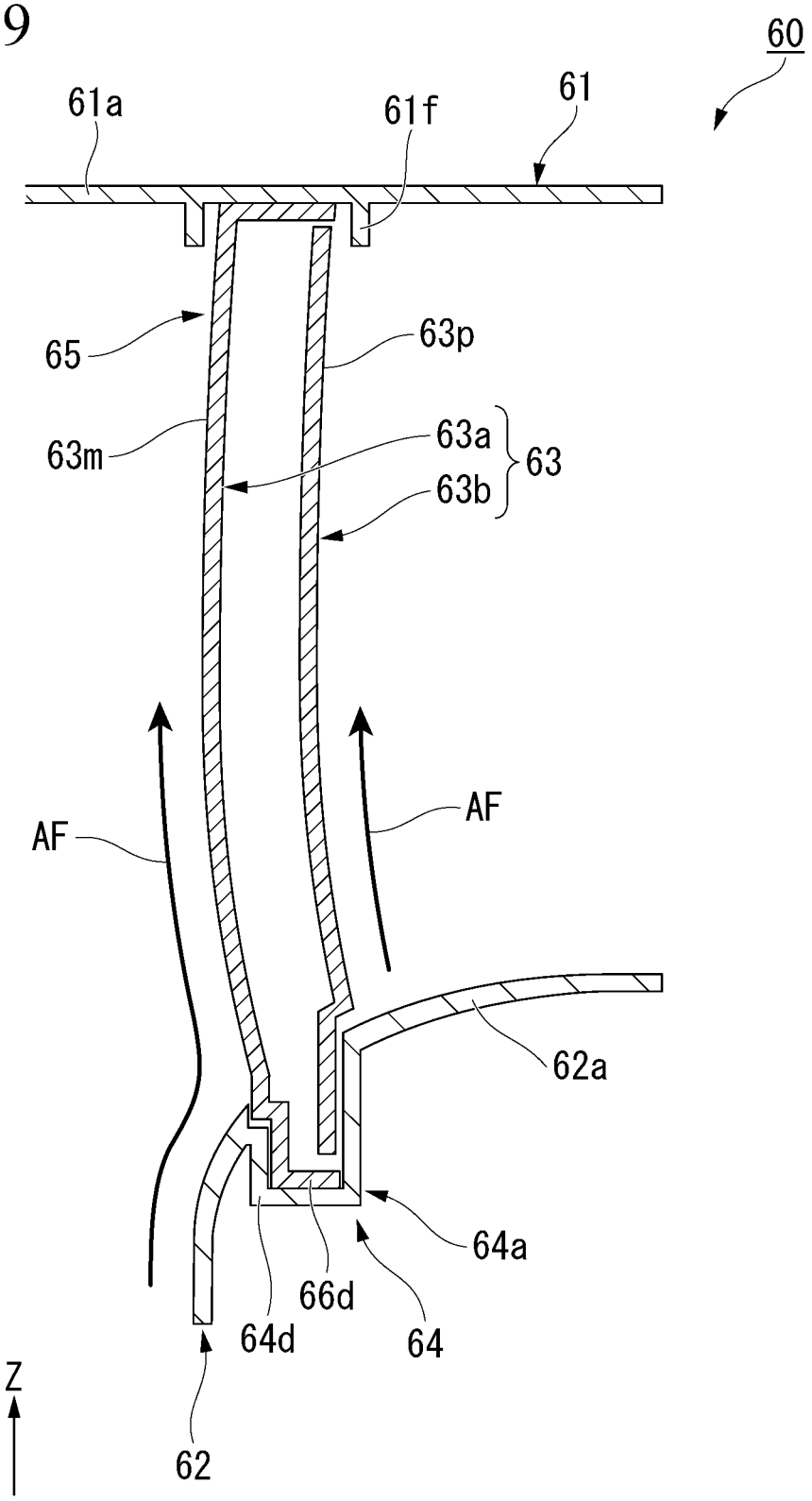
FIG. 9 A cross-sectional view that shows a part of the impeller in the first embodiment, taken from the cross-sectional line IX-IX in FIG. 5.

FIG. 8 is a perspective view that shows a blade 63. As shown in FIG. 8, the blade 63 is configured of a first blade member 63*a* and a second blade member 63*b* being combined in a direction that is orthogonal to the extension direction and to the vertical direction Z. The first blade member 63*a* is a flat box shape that opens to the outside in the radial direction. The second blade member 63*b* is a plate that blocks an opening of the second blade member 63*b* on the outside in the radial direction. The first blade member 63*a* and the second blade member 63*b* are for example, mutually fixed to one another using ultra sonic welding. FIG. 9 is a cross-sectional view that shows a part of the impeller 60, taken from the cross-sectional line IX-IX in FIG. 5. As shown in FIG. 9, a gap is provided between the first blade member 63*a* and the second blade member 63*b*. In the first embodiment, the plurality of blades 63 are hollow blades. As in FIG. 9, a direction of air flow when the impeller 60 rotates is the direction shown by the arrows AF.

The first blade member 63*a* configures a surface that inclines to the inside in the radial direction out of surfaces of the blade 63. A surface that faces the inside in the radial direction out of the surfaces of the blade 63 in the first embodiment is a negative pressure surface 63*m*. As shown in FIG. 4, the negative pressure surface 63*m* faces the inside in the radial direction and the rear side (−θ side) in the direction of rotation. The second blade member 63*b* is located on the outside in the radial direction of the first blade member 63*a*. The second blade member 63*b* configures a part of the surface that faces the outside in the radial direction out of the surfaces of the blade 63. A surface that faces the outside in the radial direction out of the surfaces of the blade 63 in the first embodiment is the positive pressure surface 63*p*. The positive pressure surface 63*p* faces the outside in the radial direction and faces the front side (+θ side) in the direction of rotation.

Each of the plurality of blades 63 has the blade main body 65. The blade main body 65 extends in a direction that inclines to the direction of rotation with respect to the radial direction, as seen from the vertical direction Z. As seen from the vertical direction Z, the blade main body 65 is located on the front side (+θ side) in the direction of rotation as the inside thereof in the radial direction is approached. As previously explained, the direction in which the blade main body 65 extends in is the extension direction, as seen from the vertical direction Z.

A first end in the extension direction of the blade main body 65 is located on an inside in the radial direction having the rotation axis R as a center thereof, and on the front side (+θ side) in the direction of rotation, more than a second end in the extension direction of the blade main body 65. The first end in the extension direction of the blade main body 65 in the first embodiment is an end in the radial direction of the blade main body 65 on the inside, and an end on the front side (+θ side) in the direction of rotation of the blade main body 65. The second end in the extension direction of the blade main body 65 in the first embodiment is an end of the blade main body 65 on the outside in the radial direction, and the end on the rear side (−θ side) in the direction of rotation of the blade main body 65.

The blade main body 65 is located between the circular plate 61*a* of the base 61 and the shroud 62 in the vertical direction Z. As shown in FIG. 9, an upper end of the blade main body 65 is connected to a bottom surface of the circular plate 61*a*, and is fixed to the bottom surface of the circular plate 61*a*. The upper end of the blade main body 65 is for example, fixed to the bottom surface of the circular plate 61*a* by laser welding. The upper end of the blade main body 65 is located on an inside of the guide 61*f*. A side surface on the upper end in the blade main body 65 is disposed apart from an inside surface of the guide 61*f*. The upper end of the blade main body 65 is not in contact with the guide 61*f*.

As shown in FIG. 8, each of the plurality of blades 63 has the protrusion 66 that protrudes to the bottom side from the blade main body 65. The protrusion 66 extends in the extension direction. More specifically, the protrusion 66 extends in a direction that a bottom end 65*a* of the blade main body 65 extends in, as seen from the vertical direction Z. The direction in which the protrusion 66 extends in, is the same direction that the protruding accommodation 64 extends in. As shown in FIG. 6, the protrusion 66 in each of the plurality of blades 63 is accommodated within each of the plurality of protruding accommodations 64.

The protrusion 66 has a first projection 66*a*. The first projection 66*a* is housed within the first accommodation 64*a*. The first projection 66*a* is a semi-rectangular shape that extends in the extension direction. The first projection 66*a* is hollow. The first projection 66*a* contacts, and is fixed to a surface located on the bottom side out of the inner surfaces of the first accommodation 64*a*. As such, the first projection 66*a* is fixed to the shroud 62. The surface located on the bottom side out of the inner surfaces of the first accommodation 64*a* is a surface that faces the top side. A bottom surface of the first projection 66*a* is for example, fixed by laser welding to the surface located on the bottom side out of surfaces of the first accommodation 64*a*. In the first embodiment, the portion out of the first projection 66*a* that is fixed to the first accommodation 64*a* is a part of the first blade member 63*a*. The portion out of the first projection 66*a* that is fixed to the first accommodation 64*a* may be a part of the second blade member 63*b*.

The first projection 66*a* has an outside portion 66*c* that is accommodated within the outside portion 64*c* of the first accommodation 64*a*, and an inside portion 66*d* that is accommodated within the inside portion 64*d* of the first accommodation 64*a*. The outside portion 66*c* is a portion on the outside in the extension direction out of the first projection 66*a*. The inside portion 66*d* is a portion on the inside in the extension direction out of the first projection 66*a*. The inside portion 66*d* is connected to an end in the extension direction of the outside portion 66*c* on the inside. The end on the outside in the extension direction of the outside portion 66*c* is an end in the extension direction of the first projection 66*a* on the outside. The end on the inside in the extension direction of the inside portion 66*d* is an end on the inside in the extension direction of the first projection 66*a*. As shown in FIG. 8, the end on the outside in the extension direction of the outside portion 66*c* is separately located to the inside in the extension direction, more than the end on the outside in the extension direction of the bottom end 65*a* of the blade main body 65.

As shown in FIG. 6, a bottom end of the outside portion 66*c* contacts, and is fixed to a surface located on the bottom side out of inner surface of the outside portion 64*c* in the first accommodation 64*a*. The bottom end of the outside portion 66*c* is located to the top side more than a bottom end of the inside portion 66*d*. The bottom end of the inside portion 66*d* contacts, and is fixed to a surface located on the bottom side out of the inner surface of the inside portion 64*d* in the first accommodation 64*a*.

A side wall portion 66*e* of the outside in the extension direction of the outside portion 66*c* extends to the bottom side in the vertical direction Z, from the bottom end 65*a* of the blade main body 65. The side wall portion 66*e* is disposed on the inside in the extension direction of the side wall portion 64*e* in the protruding accommodation 64. The side wall portion 66*e* faces the side wall portion 64*e* via a gap. The side wall portion 66*e* is not in contact with the side wall portion 64*e*.

A step wall portion 66*g* between the outside portion 66*c* and the inside portion 66*d* extends in the vertical direction Z. The step wall portion 66*g* is disposed so as to extend to the inside on the extension direction of the step wall portion 64*g* of the protruding accommodation 64. The step wall portion 66*g* faces the step wall portion 64*g* via a gap. The step wall portion 66*g* is not in contact with the step wall portion 64*g*.

A side wall portion 66*h* on the inside in the extension direction of the inside portion 66*d* extends to the bottom side of the vertical direction Z from the bottom end 65*a* blade main body 65. A bottom end of the side wall portion 66*h* is disposed on the outside in the extension direction of the step wall portion 64*h* of the protruding accommodation 64. The side wall portion 66*h* faces the step wall portion 64*h* via a gap. The side wall portion 66*h* is not in contact with the step wall portion 64*h*.

Each of plurality of protrusions 66 has the inner projection 66*b*. The inner projection 66*b* is a second projection that is connected to an inside end in the extension direction of the first projection 66*a*. As shown in FIG. 8, the inner projection 66*b* is connected to an inside end in the extension direction of the first projection 66*a*. More specifically, the inner projection 66*b* is connected to an inside end of the inside portion 66*d*, in other words, is connected to the side wall portion 66*h*. As such, in the first embodiment, each of the plurality of protrusion 66 has the inner projection 66*b*, as the second projection, that connects to an end which is located on the inside in the radial direction out of both ends in the extension direction of the first projection 66*a*. The inside end in the extension direction of the inner projection 66*b* is the inside end in the extension direction of the protrusion 66.

The inner projection 66*b* protrudes to the bottom side from an outside edge in a bottom surface of an inside end portion 65*b* located on the inside in the radial direction, more than the first projection 66*a* out of the bottom end 65*a* of the blade main body 65. The inner projection 66*b* and the inside end portion 65*b* in the first embodiment are parts of the first blade member 63*a*. The inner projection 66*b* and the inside end portion 65*b* may be parts of the second blade member 63*b*. The inner projection 66*b* protrudes to the bottom side from an edge of the inside in the radial direction and an edge of the front side (+θ side) in the direction of rotation, out of the outside edge on the bottom surface of the inside end portion 65*b*. The inner projection 66*b*, is a shape that extends to the inside in the extension direction while curving towards the outside in the radial direction, from an edge of the inside in the radial direction on the side wall portion 66*h* of the first projection 66*a*, as seen from the vertical direction Z.

An end on the bottom side of the inner projection 66*b* is located more to the top side than the lowest portion located on the bottom side out of the first projection 66*a*. In the first embodiment, the lowest portion located on the bottom side out of the first projection 66*a* is the bottom end of the inside portion 66*d*. The end on the bottom side of the inner projection 66*b* is located more to the bottom side than the bottom end of the outside portion 66*c*.

An end out of ends in the extension direction of the inner projection 66*b*, that is on an opposite side to the side that the first projection 66*a* is connected to, in other words the end on the inside in the extension direction, is connected to an end on the inside in the extension direction of the blade main body 65 with no step. A surface on the inside in the extension direction of the inner projection 66*b* is smoothly connected to a surface on the inside in the extension direction of the blade main body 65. A surface on the inside in the radial direction of the inner projection 66*b* is smoothly connected to the negative pressure surface 63*m* of the blade main body 65.

As shown in FIG. 6, the inner projection 66*b* is accommodated within the inner accommodation 64*b*. The inner projection 66*b* is located so as to oppose a surface located on the bottom side out of inner surface of the inner accommodation 64*b* with a gap in between. A bottom end of the inner projection 66*b* is separately disposed on the top side from a surface located on the bottom side out of the inner surface of the inner accommodation 64*b*. The inner projection 66*b* is located on the outside in the extension direction side wall portion 64*f* on the inner accommodation 64*b*. The inner projection 66*b* is located so as to oppose the side wall portion 64*f* via a gap. The gap between the inner projection 66*b* and the side wall portion 64*f* is smaller than the gap located between the inner projection 66*b* and the surface located on the bottom side out of the inner surface of the inner accommodation 64*b*. An entirety of the inner projection 66*b* is separately disposed from the inner surface of the inner accommodation 64*b*. The inner projection 66*b* is not in contact with the inner surface of the inner accommodation 64*b*.

Figure 10:
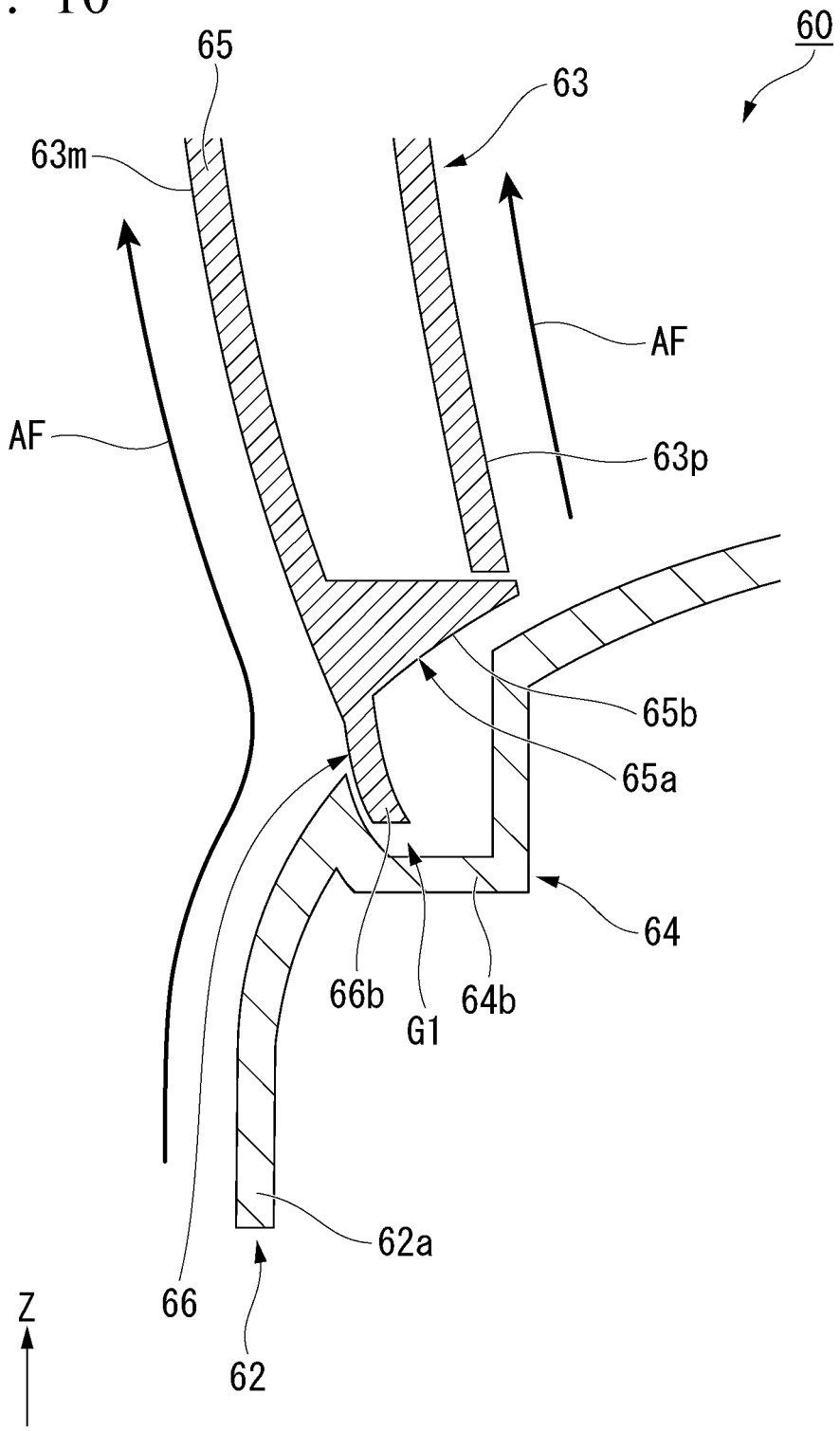
FIG. 10 A cross-sectional view that shows a part of the impeller in the first embodiment, taken from the cross-sectional line X-X in FIG. 5.

FIG. 10 is a cross-sectional view that shows a part of the impeller 60, taken from the cross-sectional line X-X in FIG. 5. In FIG. 10, a flow of the air when the impeller 60 rotates, is shown by the arrows AF. As shown in FIG. 10, a gap G1 is provided between the inside end portion 65*b* of the blade main body 65 and the shroud 62. The gap G1 is connected to an interval of the positive pressure side that the positive pressure surface 63*p* faces, and to an interval of the negative pressure side that the negative pressure surface 63*m* faces. The gap G1 includes the gap between the inner projection 66*b* and an inner surface of the inner accommodation 64*b*, an inner space of the inner accommodation 64*b*, and the gap between the inside end portion 65*b* and the shroud main body 62*a*. By having the gap G1 be inserted between the inside of the inner accommodation 64*b* and the inner projection 66*b*, a labyrinth structure that penetrates in the vertical direction Z is formed.

Figure 17:
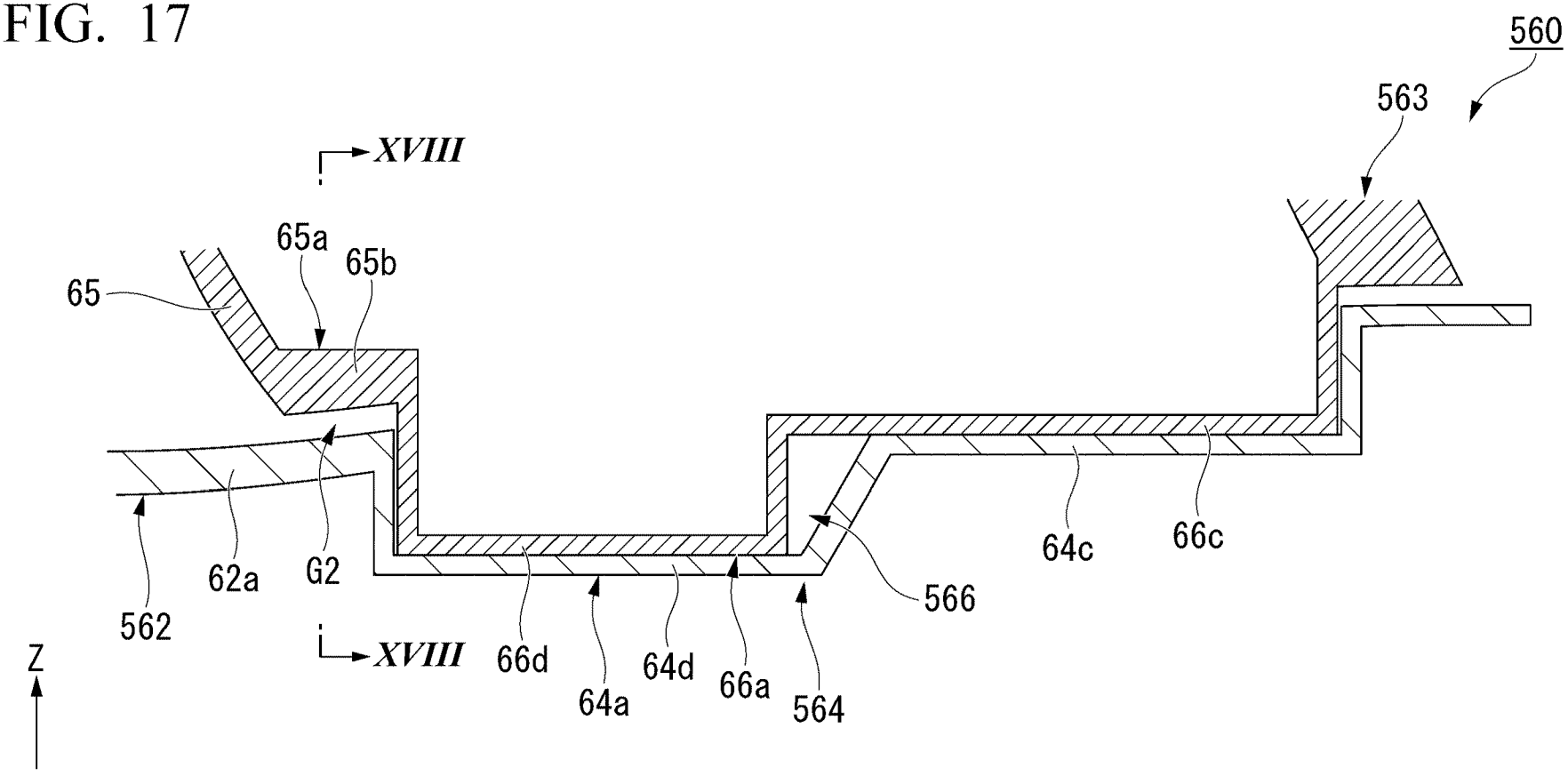
FIG. 17 A cross-sectional view that shows a part of an impeller in a comparative example.
Figure 18:
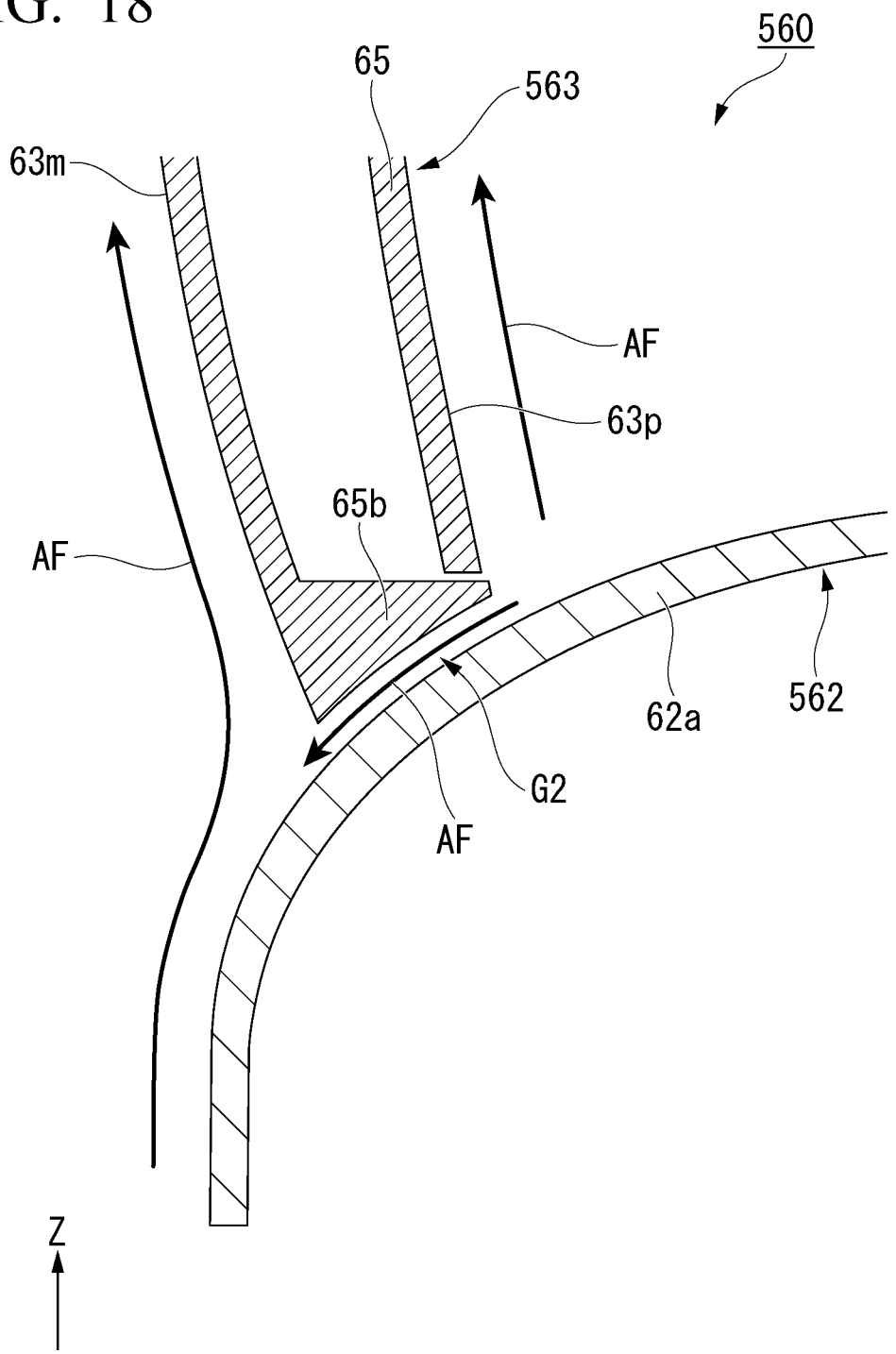
FIG. 18 A cross-sectional view that shows a part of the impeller in the comparative example, taken from a cross-sectional line XVIII-XVIII in FIG. 17.

FIG. 17 is a cross-sectional view that shows a part of an impeller 560 in a comparative example. FIG. 18 is a cross-sectional view that shows a part of the impeller 560 in the comparative example, taken from a cross-sectional line XVIII-XVIII in FIG. 17. A direction of flow of the air when the impeller 560 rotates is shown in FIG. 18 by the arrows AF. As shown in FIG. 17 and in FIG. 18, With the exception of an aspect of a protruding accommodation 564 not having the inner accommodation 64*b*, a shroud 562 of the impeller 560 in the comparative example is the same as the shroud 62 of the impeller 60 of the first embodiment. With the exception of an aspect of a protrusion 566 not having the inner projection 66*b*, a blade 563 of the impeller 560 is the same as the blade 63 of the impeller 60 of the first embodiment.

A gap G2 is provided between the inside end portion 65*b* of the blade main body 65 and an inner surface of the surface of the shroud main body 62*a*. As shown in FIG. 18, the gap G2 is provided so as to extend along an inner surface of the shroud main body 62*a* in the radial direction. The gap G2 opens to both sides in the radial direction, and is connected to the interval of the positive pressure side that the positive pressure surface 63*p* faces, and to the negative pressure side that the negative pressure surface 63*m* faces. Therefore, as shown by the arrows AF in FIG. 18, there are cases in the impeller 560 of the comparative example where the air flows from the interval of the positive pressure side that the positive pressure surface 63*p* faces, to the interval of the negative pressure side that the negative pressure surface 63*m* faces, passing through the gap G2. As such, a problem of decrease in air blowing efficiency due to the impeller 560 exists.

With respect to said problem, each of the plurality of protruding accommodations 64 in the shroud 62 according to the first embodiment has the first accommodation 64*a*, and the inner accommodation 64*b* that is connected to the end in the extension direction of the first accommodation 64*a*. The protrusion 66 in the blade 63 is accommodated within the first accommodation 64*a*, is connected to the first projection 66*a* that is fixed to the shroud 62 and an end in the extension direction of the first projection 66*a*, and has the inner projection 66*b* that is accommodated within the inner accommodation 64*b*. The first projection 66*a* contacts, and is fixed to a surface located on the bottom side out of the inner surfaces of the first accommodation 64*a*. The inner projection 66*b* opposes the surface located on the bottom side out of the inner surface of the inner accommodation 64*b* via a gap. As such, by providing the inner accommodation 64*b* and the inner projection 66*b* accommodated within the inner accommodation 64*b*, it is possible to have the gap G1 between the inside end portion 65*b* of the blade main body 65 and the shroud main body 62*a* be the previously mentioned penetrating shape. Accordingly, it is possible to have it to where it is difficult for air to pass through the gap G1. Accordingly, it is possible to suppress the air from flowing from the interval of the positive pressure side that the positive pressure surface 63*p* faces to the interval of the negative pressure side that the negative pressure surface 63*m* faces, via the gap G1. Therefore, it is possible to suppress the decrease in air blowing efficiency of the impeller 60 in the centrifugal blower 40. Since the inner projection 66*b* does not contact the surface located on a bottom side out of the inner surface of the inner accommodation 64*b*, it is possible to have the first projection 66*a* suitably contact the surface located on the bottom side out of the inner surface of the first accommodation 64*a*.

According to the first embodiment, each of the plurality of protruding accommodation 64 has the inner accommodation 64*b*, as the second accommodation, connect to the end located on the inside in the radial direction out of both ends in the extension direction of the first accommodation 64*a*. The protrusion 66 has the inner projection 66*b* as the second projection that connects to an end located on the inside in the radial direction out of both ends in the extension direction of the first projection 66*a*. The inner projection 66*b* is accommodated within the inner accommodation 64*b*. As such, it is possible to suppress the flow of the air from the positive pressure side to the negative pressure side, on the inside in the extension direction of the first projection 66*a*. Since a part on the inside in the extension direction out of the blade 63 separates the air that is taken from the air intake port 60*a*, it is especially easy for the positive pressure to rise in the air of the positive pressure side. As such, by suppressing the air flow from the positive pressure side to the negative pressure side on the inside in the extension direction of the first projection 66*a*, it is possible suitably suppress the decrease in the air blowing efficiency of the impeller 60.

According to the first embodiment, the end on the bottom side of the inner accommodation 64*b* is located to the top side more than the lowest portion located on the bottom side out of the first accommodation 64*a*. An end on the bottom side of the inner projection 66*b* is located to the top more than the lowest portion located on the bottom side out of the first projection 66*a*. As such, even if the inner accommodation 64*b* and the inner projection 66*b* are provided, the inner accommodation 64*b* would not protrude to the bottom side more than the first accommodation 64*a*. As such, it is possible to suppress the inner accommodation 64*b* from becoming resistance to the air flow when the impeller 60 rotates. Also, when welding the first projection 66*a* and the first accommodation 64*a* for example, a glass plate or the like is pushed up against the first accommodation 64*a* from the bottom side, and the bottom surface of the first projection 66*a* and the surface located on the bottom side out of the inner surface of the first accommodation 64*a* are in close contact with one another. In such case, by the inner accommodation 64*b* not protruding to the bottom side more than the first accommodation 64*a*, it is possible to suitably push the glass plate or the like against the first accommodation 64*a*. Therefore, it is possible to suitably fix the first projection 66*a* and the first accommodation 64*a* using laser welding.

According to the first embodiment, the entirety of the inner projection 66*b* is separately disposed from the inner surface of the inner accommodation 64*b*. In other words, the inner projection 66*b* is not in contact with the inner surface of the inner accommodation 64*b*. As such, when a small vibration is generated in the blade 63, it is possible to suppress contact of the vibrating inner projection 66*b* with the inner surface of the inner accommodation 64*b*. Accordingly, it is possible to suppress noise generation when the impeller 60 is rotating. In the first embodiment, portions out of the blade 63 that are not fixed by laser welding are not in contact with the shroud 62. As such, it is possible to more suitably suppress vibrating portions out of the blade 63 from contacting the shroud 62, and it is possible to more suitably suppress noise generation when the impeller 60 is rotating.

According to the first embodiment, an end on the opposite side to the side to which the first projection 66*a* out of ends in the extension direction of the inner projection 66*b* is connected to the end in the extension direction of the blade main body 65 with no step. As such, no step forms between the inner projection 66*b* and the blade main body 65, and no gap forms between said step and the shroud main body 62*a*. Accordingly, the air does not flow from the positive pressure side to the negative pressure side via the gap between said step and the shroud main body 62*a*. Therefore, it is possible to suitably suppress a decrease in air blowing efficiency of the impeller 60.

Second Embodiment

Figure 11:
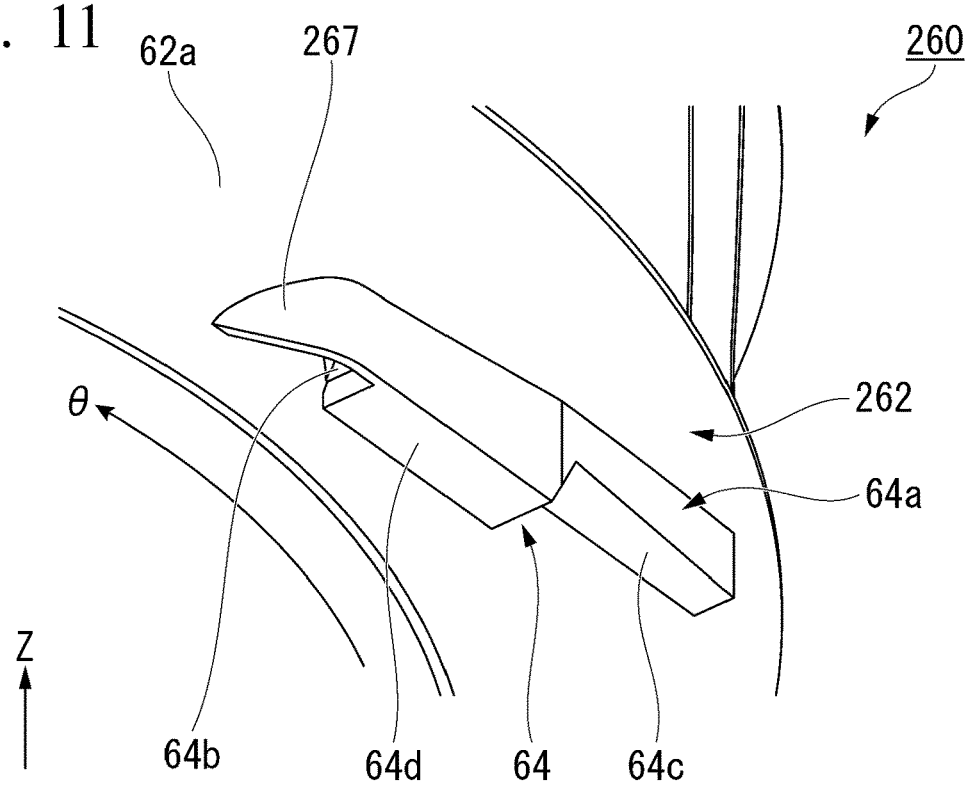
FIG. 11 A perspective view that shows a part of an impeller in a second embodiment.
Figure 12:
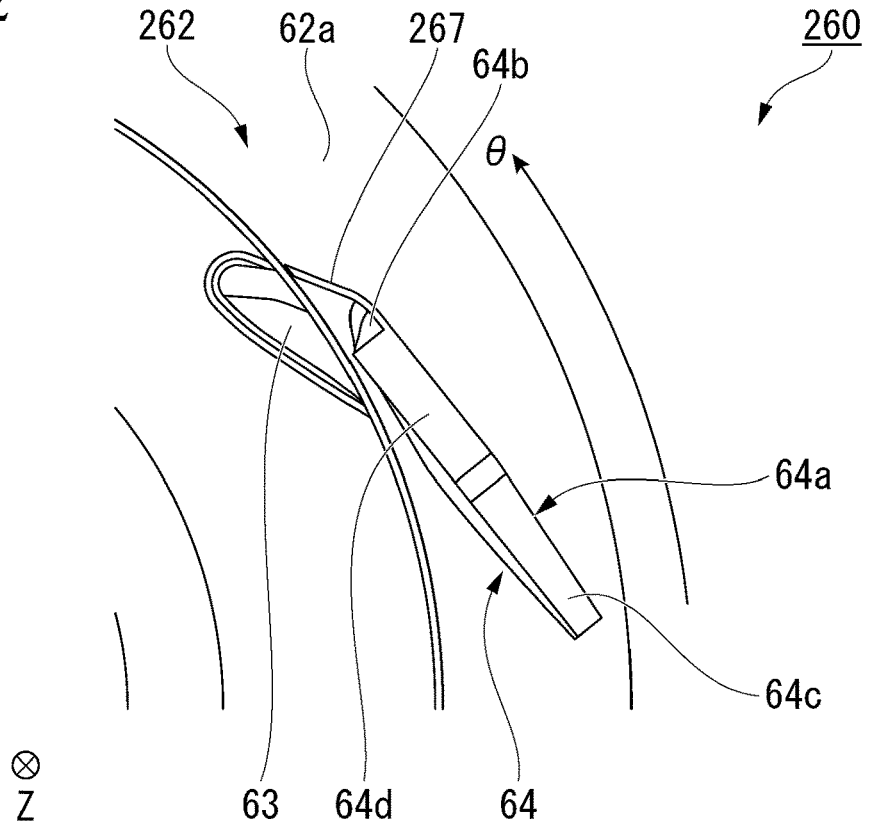
FIG. 12 A view that shows a part of the impeller as seen from the bottom side in the second embodiment.

FIG. 11 is a perspective view that shows a part of an impeller 260 in a second embodiment. FIG. 12 is a view that shows the part of the impeller 260 as seen from the bottom side in the second embodiment. In the explanations below, configurations that are similar to configurations of embodiments previously mentioned have the same reference signs affixed thereto, with explanations thereof being omitted.

As shown in FIG. 11 and in FIG. 12, a shroud 262 of an impeller 260 has a cover portion 267 that protrudes from the bottom side of the shroud main body 62*a*. The cover portion 267 extends while curving towards the inside in the radial direction, from the outside in the radial direction of the inner accommodation 64*b*, to the front side (+0 side) in the direction of rotation, and covers the inner accommodation 64*b* from the front side in the direction of rotation. An end in the rear side (−θ side) in the direction of rotation of the cover portion 267 is connected to an outside end in the radial direction of the inside end in the extension direction of the first accommodation 64*a*.

As shown in FIG. 11, an end on the bottom side of the cover portion 267 is located to the bottom side more than the end on the bottom side of the inner accommodation 64*b*. The end on the bottom side of the cover portion 267 is disposed in the same location in the vertical direction Z as the end on the bottom side of the inside portion 64*d* in the first accommodation 64*a*. As shown in FIG. 12, the cover portion 267 is connected to the outside in the radial direction of the inner accommodation 64*b*. A portion of the cover portion 267 configures a wall of the outside in the radial direction of the inner accommodation 64*b*. An end on the top side of the cover portion 267 is located in the bottom side as an inside thereof in the radial direction is approached, along an outside surface of the shroud main body 62*a*. A dimension of the cover portion 267 in the vertical direction Z becomes smaller as the cover portion 267 faces the inside in the radial direction.

Other configurations of the shroud 262 are the same as the other configurations of the shroud 62 in the first embodiment. Other configurations of the impeller 260 are the same as the other configurations of the impeller 60 in the first embodiment.

According to the second embodiment, the shroud 262 has the cover portion 267 that protrudes to the bottom side from the shroud main body 62*a*. An end on the bottom side of the cover portion 267 is located to the bottom side more than the end on the bottom side of the inner accommodation 64*b*. The cover portion 267 extends while curving towards the inside in the radial direction, from the outside in the radial direction of the inner accommodation 64*b*, to the front side (+θ side) in the direction of rotation, and covers the inner accommodation 64*b* from the front side in the direction of rotation. As such, when the impeller 260 rotates, it is possible to ward off the air from the front side in the direction of rotation using the cover portion 267, and it is possible to suppress the air from the front side in the direction of rotation from colliding with the inner accommodation 64*b*. Accordingly, it is also possible to suppress noise generation when the impeller 260 is rotating.

According to the second embodiment, the cover portion 267 is connected to the outside in the radial direction of the inner accommodation 64*b*. Accordingly, compared to when the cover portion 267 is separately made from the inner accommodation 64*b*, making the cover portion 267 and the inner accommodation 64*b* together is easier. Accordingly, it is possible to easily make the cover portion 267.

Third Embodiment

Figure 13:
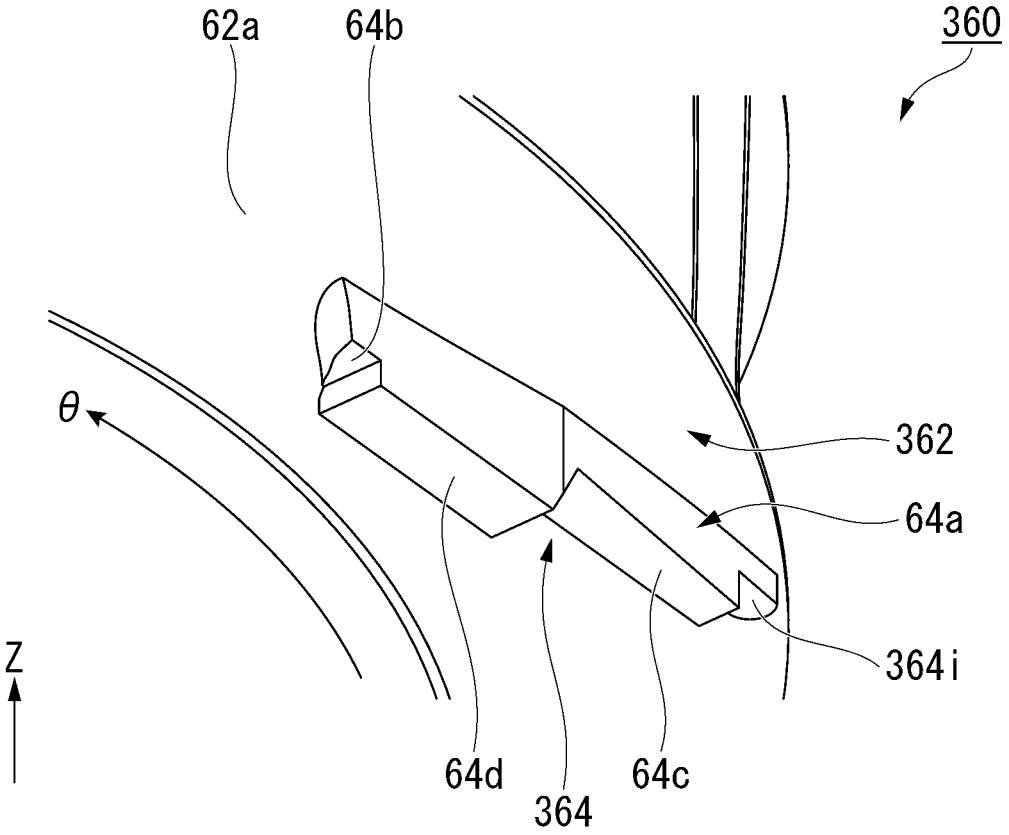
FIG. 13 A perspective view that shows a part of an impeller in a third embodiment.
Figure 14:
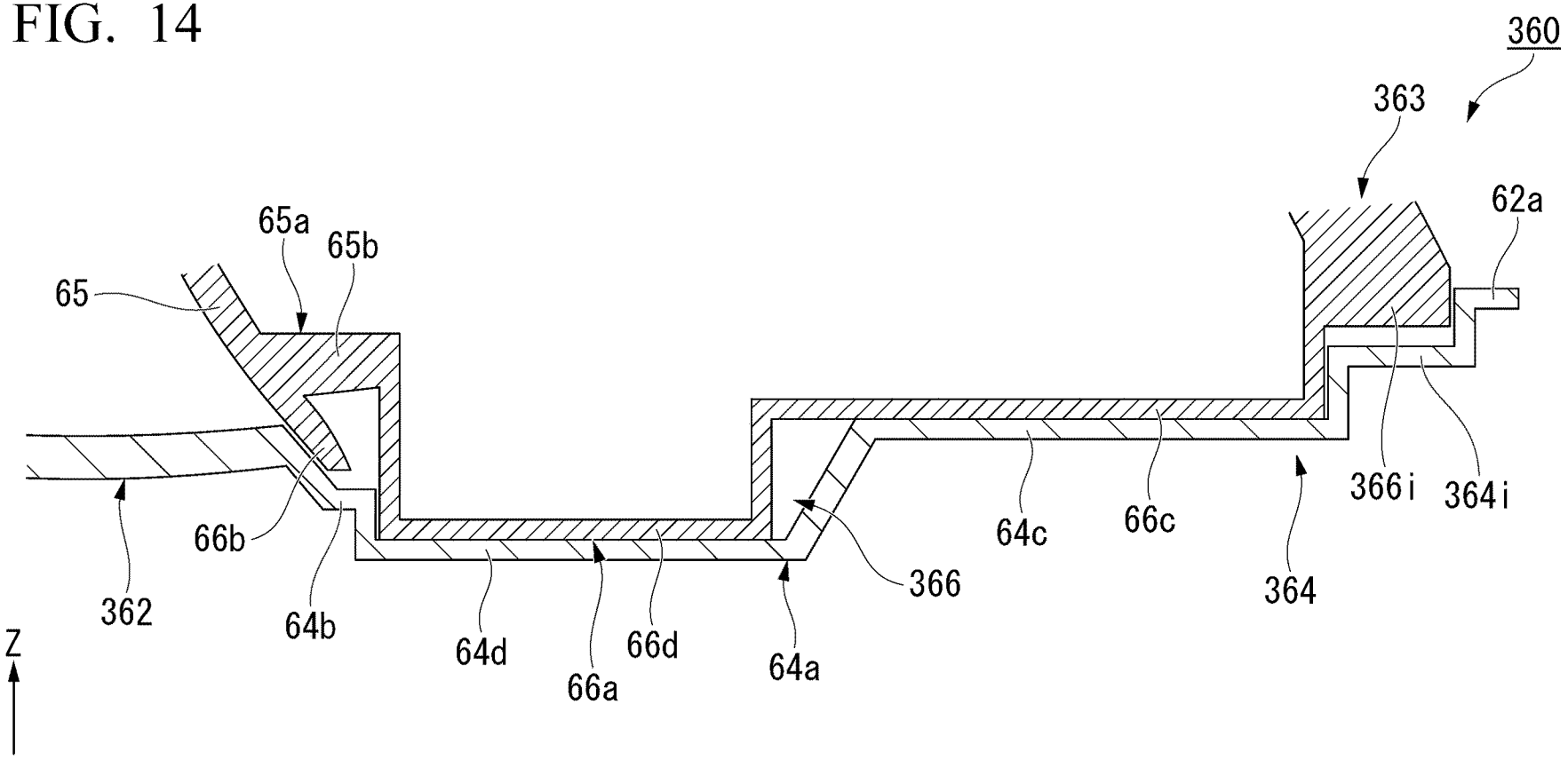
FIG. 14 A cross-sectional view that shows a part of the impeller in the third embodiment.
Figure 15:
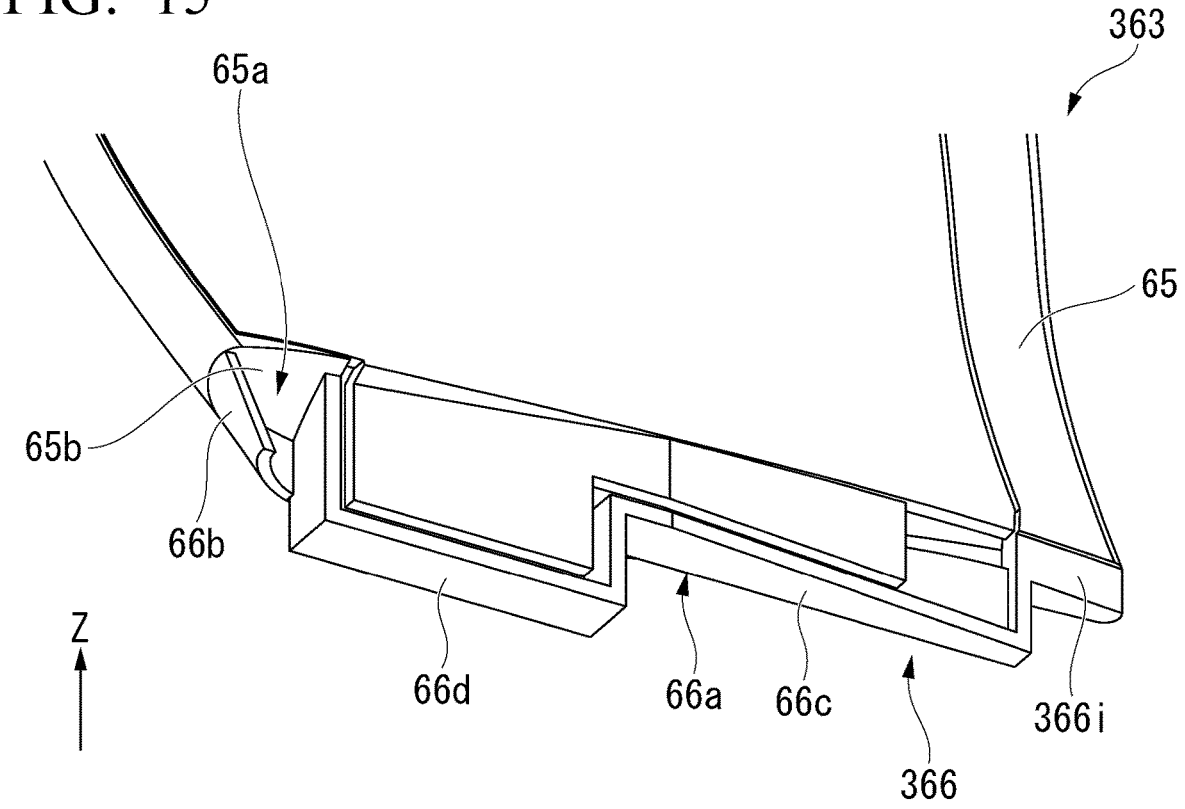
FIG. 15 A perspective view that shows a part of the blade in the third embodiment.

FIG. 13 is a perspective view that shows a part of an impeller 360 in a third embodiment. FIG. 14 is a cross-sectional view that shows the part of the impeller 360 in the third embodiment. FIG. 15 is a perspective view that shows a part of a blade 363 in the third embodiment. In the explanations below, configurations that are similar to configurations of embodiments previously mentioned have the same reference signs affixed thereto, with explanations thereof being omitted.

As shown in FIG. 13 and FIG. 14, a protruding accommodation 364 in a shroud 362 of the third embodiment has an outer accommodation 364*i* that connects to an end located on the outside in the radial direction out of both ends in the extension direction of the first accommodation 64*a*, as a second accommodation. The outer accommodation 364*i* is connected to the end of the outside in the extension direction of the outside portion 64*c*. The outer accommodation 364*i* extends in the extension direction, and is a semi-rectangular box that opens to the top side. An end of a bottom side of the outer accommodation 364*i* is located to the top side more than the end on the bottom side in the outside portion 64*c* of the first accommodation 64*a*. Other configurations of the shroud 362 are the same as the other configurations of the shroud 62 in the first embodiment.

As shown in FIG. 14 and FIG. 15, a protrusion 366 in the blade 363 of the third embodiment has an outer protrusion 366*i* that connects to an end located on the outside in the radial direction out of both ends in the extension direction of the first projection 66*a*, as a second projection. The outer protrusion 366*i* is connected to an end on the outside in the extension direction of the outside portion 66*c*. The outer protrusion 366*i* is a semi-rectangular shape that extends in the extension direction. The outer protrusion 366*i* in the third embodiment is a solid part.

As shown in FIG. 14, the outer protrusion 366*i* is accommodated on an inside of the outer accommodation 364*i*. An end on a bottom side of the outer protrusion 366*i* is located more to the top side than an end on the bottom side in the outside portion 66*c* of the first projection 66*a*. The outer protrusion 366*i* faces a surface located on the bottom side out of an inner surface of the outer accommodation 364*i* via a gap. Other configurations of the blade 363 are the same as the other configurations of the blade 63 in the first embodiment. Other configurations of the impeller 360 are the same as the other configurations of the impeller 60 in the first embodiment.

According to the third embodiment, the protruding accommodation 364 has the outer accommodation 364*i* that connects to an end located on the outside in the radial direction out of both ends in the extension direction of the first accommodation 64*a*, as the second accommodation. The protrusion 366 has the outer protrusion 366*i* that connects to an end located on the outside in the radial direction out of both ends in the extension direction of the first projection 66*a* as a second projection. The outer protrusion 366*i* is accommodated on the inside of the outer accommodation 364*i*. As such, it is possible to suppress the air on the outside in the extension direction of the first projection 66*a* from flowing from the positive pressure side to the negative pressure side. Accordingly, it is possible to suitably suppress a decrease in the air blowing efficiency of the impeller 360.

Fourth Embodiment

Figure 16:
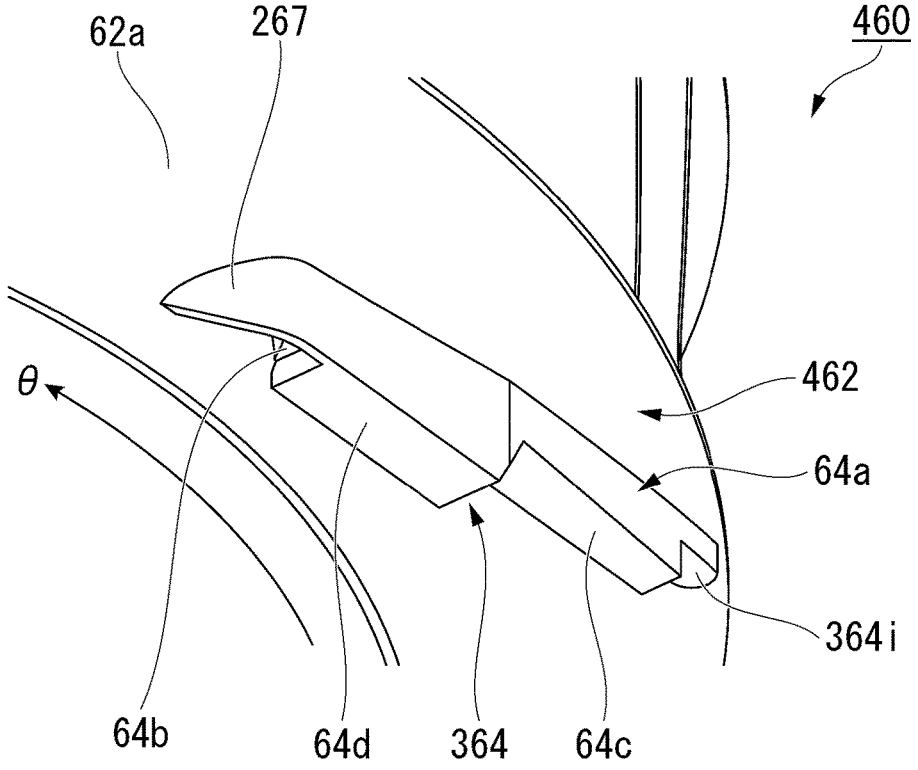
FIG. 16 A perspective view that shows a part of an impeller in a fourth embodiment.

FIG. 16 is a perspective view that shows a part of an impeller 460 in a fourth embodiment. In the explanations below, configurations that are similar to configurations of embodiments previously mentioned have the same reference signs affixed thereto, with explanations thereof being omitted.

As shown in FIG. 16, a shroud 462 of the impeller 460 in the fourth embodiment is a configuration having the cover portion 267 provided, with respect to the previously mentioned shroud 362 of the third embodiment. Although omitted from the drawings, a blade in the fourth embodiment is the same as the blade 363 in the third embodiment. Accordingly, various effects mentioned in the second embodiment and in the third embodiment are obtained by the fourth embodiment. Other configurations of the impeller 460 are the same as the other configurations of the impeller 60 of the first embodiment.

Although embodiments of the present disclosure have been explained above, the present disclosure is not limited to configurations of the each of the embodiments and the configurations and methods below may be adopted.

As a second accommodation, a protruding accommodation in a shroud may at least be one of an inner accommodation or an outer accommodation. In other words, the protruding accommodation in the shroud may only have an outer accommodation as the second accommodation. For example, in the aforementioned third and fourth embodiments, the inner accommodation 64*b* need not be provided. A protrusion height of the second accommodation is not particularly limited. An end of the first side (the bottom side) of the second accommodation is at the same location in the axial direction (the vertical direction Z) as the portion located furthest in the first side out of the first accommodation, or may be at the same location as a portion located before the portion located furthest in the first side out of the first accommodation. The second accommodation may be any shape so long as said shape is capable of accommodating a second projection.

The first accommodation of the protruding accommodation may be any shape so long as it is possible to accommodate the first projection therein. Although the first accommodation 64*a* in the previously mentioned embodiments has configurations where heights of the outside portion 64*c* and the inside portion 64*d* differ from one another, the first accommodation 64*a* is not limited thereto. The first accommodation need not have a portion that has a differing height, and may have three or more portions that mutually have differing projection heights.

The projection in the blade at least has one of an inner projection or an outer projection, as the second projection. In other words, the projection in the blade may only have the outer projection, as the second projection. For example, in the previously mentioned third and fourth embodiments, the inner projection 66*b* need not be provided. The height of the second projection is not particularly limited. An end of a first side (the bottom side) of the second projection is at the same location in the axial direction (the vertical direction Z) as the portion located furthest in the first side out of the first projection, or may be at the same location as a portion located before the portion located furthest in the first side out of the first projection. The second projection may be of any shape. For example, the shape of the inner projection 66*b* in the previously mentioned various embodiments may be the same shape as the outer protrusion 366*i* in the third embodiment. So long as the second projection faces a surface that is located on the first side out of the inner surface of the second accommodation via a gap, the second protrusion may have a portion that contacts the inner surface of the second accommodation.

So long as the first projection of the first protrusion is fixed to the first accommodation, the first projection may be of any shape. Although the first projection 66*a* in the previously mentioned various embodiments has a configuration where projection heights of the outside portion 66*c* and of the inside portion 66*d* mutually differ, the first projection 66*a* is not limited thereto. The first projection may not have portions that mutually have differing projection heights, and may have three or more portions that have differing projection heights. Parts other than parts out of the first projection that are fixed to the first accommodation may be in contact with the inner surface of the first accommodation. The first projection may be fixed to the shroud by methods other than laser welding.

The cover portion of the shroud need not be connected to the inner accommodation, and need not be connected to the first accommodation. A number of blades and a number of protrusions of the shroud are not particularly limited. A shape of a blade main body is not particularly limited. The blade main body may extend in the axial direction (the vertical direction Z) in any way. A layout relationship between a first blade member and a second blade member that configure the blade may be an opposite layout relationship to the layout relationship of the previously mentioned embodiments. In other words, the second blade member may face a negative pressure side. Each blade may be an integrally formed solid blade. The axial direction of the direction of rotation of an impeller in the present disclosure is not limited in any way, and may extend in a direction other than the vertical direction. The impeller of the present disclosure may be mounted on any blower. A centrifugal blower of the present disclosure may be mounted on any device.

The various configuration and various methods explained in the above specification may be combined as needed so long as no conflicts therebetween with technical scopes thereof occur.

The invention claimed is:

1. An impeller, the impeller being rotatable around a rotation axis, the impeller comprises:

a base;

a shroud that is located on a first side out of an axial direction of the rotation axis with respect to the base, and a plurality of blades that are located between the base and the shroud in the axial direction, and are disposed with an interval therebetween in a direction of rotation of the impeller, wherein the shroud has a shroud main body, and a plurality of protruding accommodations that protrude from the shroud main body to the first side, and that open to a second side which is an opposite side to the first side out of the axial direction, each of the plurality of blades has a blade main body, and a protrusion that protrudes to the first side from the blade main body, a first end of the blade main body is located closer to the rotation axis of the impeller than a second end of the blade main body in an extension direction that the blade main body extends in, as seen from the axial direction, the protrusion in the plurality of blades is accommodated within each of the plurality of protruding accommodations, each of the protruding accommodations has a first accommodation, and a second accommodation that is connected to an end in the extension direction of the first accommodation, the protrusion has a first projection that is accommodated within the first accommodation, and is fixed to the shroud, and a second projection that is connected to an end in the extension direction of the first projection, and is accommodated within the second accommodation, and the first projection contacts and is fixed to a surface located on the first side out of an inner surface of the first accommodation, the second projection faces a surface located on the first side out of an inner surface of the second accommodation via a gap, an end out of ends in the extension direction of the second projection, that is on an opposite side to the side to which the first projection is connected to, is connected to the first end in the extension direction of the blade main body with no step, the protruding accommodations are each formed in a shape of a semi-rectangular box, and the second projection is accommodated within the second accommodation, so that the gap forms a labyrinth structure that penetrates in a vertical direction.

2. The impeller according to claim 1, wherein in each of the plurality of protruding accommodations, the second accommodation is an inner accommodation that connects to an end located on an inside in the radial direction out of both ends in the extension direction of the first accommodation, in the protrusion, the second projection is an inner projection that connects to an end located on the inside in the radial direction out of both ends in the extension direction of the first projection, and the inner projection is accommodated within the inner accommodation.

3. The impeller according to claim 2, wherein the first end in the extension direction of the blade main body is located on an inside in the radial direction, and on a front side in the direction of rotation, more than the second end in the extension direction of the blade main body, the shroud has a cover portion that protrudes from the shroud main body to the first side, an end of the first side of the cover portion is located more to the first side than the end of the first side of the inner accommodation, and the cover portion extends while curving towards the inside in the radial direction, from an outside in the radial direction of the inner accommodation, to the front side in the direction of rotation, and covers the inner accommodation from the front side in the direction of rotation.

4. The impeller according to claim 3, wherein the cover portion is connected to the outside in the radial direction of the inner accommodation.

5. The impeller according to claim 1, wherein the protruding accommodation has an outer accommodation that connects to an end located on an outside in the radial direction out of both ends in the extension direction of the first accommodation, as a second accommodation, the protrusion has an outer protrusion that connects to an end located on the outside in the radial direction out of both ends in the extension direction of the first projection, as a second projection, and the outer protrusion is accommodated within the outer accommodation.

6. The impeller according to claim 1, wherein an end of the first side of the second accommodation is located in the second side more than a portion located furthest in the first side out of the first accommodation, and an end of the first side of the second projection is located in the second side more than a portion located furthest in the first side out of the first projection.

7. The impeller according to claim 1, wherein an entirety of the second projection is separately disposed from an inner surface of the second accommodation.

8. A centrifugal blower further comprising:

the impeller according to claim 1, and a drive portion that rotates the impeller around the rotation axis.

9. An indoor unit further comprising:

the centrifugal blower according to claim 8, and a heat exchanger that has air which is blown by the centrifugal blower.

* * * * *